United States Patent [19]

Hotea et al.

[11] Patent Number: 5,076,806

[45] Date of Patent: Dec. 31, 1991

[54] ELECTRICAL CONNECTOR HAVING IMPROVED SECONDARY RETENTION MEANS

[75] Inventors: Gheorghe Hotea, Griesheim; Jurgen Hass, Erzhausen, both of Fed. Rep. of Germany

[73] Assignee: AMP Incorporated, Harrisburg, Pa.

[21] Appl. No.: 692,804

[22] Filed: Apr. 25, 1991

Related U.S. Application Data

[63] Continuation of Ser. No. 602,577, Oct. 23, 1990, abandoned.

[30] Foreign Application Priority Data

Oct. 24, 1989 [GB] United Kingdom ..... 8923857
Oct. 24, 1989 [GB] United Kingdom ..... 8923858

[51] Int. Cl.[5] ..... H01R 13/44

[52] U.S. Cl. ..... 439/595; 439/596; 439/752; 439/587; 439/278

[58] Field of Search ..... 439/278, 281–283, 439/587–589, 595–597, 603, 752

[56] References Cited

U.S. PATENT DOCUMENTS

| | | | |
|---|---|---|---|
| 4,114,971 | 9/1978 | Heinbrock | 439/596 |
| 4,497,531 | 2/1985 | Baker | 339/94 |
| 4,705,337 | 11/1987 | Maeda | 439/595 |
| 4,711,508 | 12/1987 | Sueyoshi | 439/595 |
| 4,750,893 | 6/1988 | Sueyoshi et al. | 439/596 |
| 4,758,536 | 7/1988 | Miller et al. | 439/138 |
| 4,767,361 | 8/1988 | Hoshino et al. | 439/596 |
| 4,776,813 | 10/1988 | Wilson et al. | 439/595 |
| 4,867,705 | 9/1989 | Yusa | 439/595 |
| 4,979,913 | 12/1990 | Aiello et al. | 439/596 |
| 4,984,998 | 1/1991 | Duncan et al. | 439/595 |
| 5,002,504 | 3/1991 | Carlson | 439/595 |

*Primary Examiner*—Paula A. Bradley
*Attorney, Agent, or Firm*—Bruce J. Wolstoncroft

[57] ABSTRACT

An electrical connector assembly is shown as including an outer shell member (4) which can receive a pin housing (50) from a rear entry. The pin housing includes a rotatable secondary lock member (90) which is snap latchable into place. Terminals 120 are also insertable into the pin housing (50). A multi-conductor cable (340) has individual conductors (344) which are terminated to the crimp sections (127) of the terminals. To seal the connector, a sealing grommet (130) is insertable over the cable (340) and is slidable into the shell (4).

20 Claims, 22 Drawing Sheets

ELECTRICAL CONNECTOR HAVING IMPROVED SECONDARY RETENTION MEANS

This application is a continuation of application Ser. No. 07/602,557 filed Oct. 23, 1990 now abandoned.

The subject invention relates to an improved electrical connector housing and more particularly to an improved secondary retention feature for the retention of electrical terminals within their housing.

It is quite common in the electrical connector industry today to require that electrical terminals have redundant retention means within their connector housings. The first or primary means of retaining the electrical terminals within the housing is to have a stamped out lance from the electrical terminal metal body which abuts a shoulder within the housing The redundant or secondary retention means is typically profiled as a plastic moveable member which can be moved into place over the terminal to lock the terminal in place. Some of these members are moved transversely of the axial direction, while some are defined as hinged flaps which are rotated into place. These flaps include plastic tabs which, when rotated, reside in a groove or gap within the terminal to retain the contact in place.

In one prior method, as shown for example in U.S. Pat. No. 4,750,893, an electrical connector housing has a hinged flap which rotates into place. The electrical connector has an insulating housing and a plurality of electrical terminals disposed in terminal receiving passageways within the housing The housing includes an upper retention flap including a retention tab which, when in its locked location, is positioned adjacent to an edge of the terminal to retain the terminal in the passageway. The flap has tabs which reside at an edge of the contact to prevent withdrawal thereof If more than one row of contacts is present, then two hinged flaps on the outside of the each of the two rows are used to retain the terminals in place.

It is also quite common in the electrical connector industry today to require that electrical terminals have sealing means to prevent the internal structure of the connector housing from the ingress of moisture and contaminants. It is common then to have some form of sealing grommet around a cable or to have a rear seal with a plurality of apertures through it, which are profiled to receive a wire therethrough.

In one prior method, as shown for example in U.S. Pat. No. 4,497,531, an electrical connector has a rear seal member with a plurality of apertures for the receipt therethrough of a plurality of discrete wires. The connector housing has a plate which rotates to reside against the rear of the seal to retain the seal in place. While this design is beneficial for its intended purpose, that is to retain the seal in place, the disadvantage is that the plate does not help in the sealing function, that is, the plate does not help to compress the seal against the wires A further disadvantage of the retainer is that the retainer does not assist to position the seal in place, but rather only retains the seal in place once in position.

The object of the invention then is to provide for an electrical connector where the terminals in an upper and lower row can be retained by the same retainer flap.

The above mentioned object was accomplished by providing for a connector assembly characterized in that the housing includes at least an upper and lower row of terminal passageways, where the upper and lower rows are laterally staggered, and the housing includes an aperture between two adjacent passageways in the upper row. The aperture communicates with a passageway in the lower row which is intermediate to the upper two passageways, such that the tab is insertable into the lower row passageway to retain an electrical terminal in the lower row.

It is another object of the invention to provide for a sealed electrical connector where the seal is retained in place and compressed against the wire when the connector is in its assembled condition.

It is a further object of the invention to provide for a sealed connector where the seal can be placed around a multiconductor cable and inserted into the rear face of a connector housing, where the retention means of the connector retains the seal to the cable during the insertion, thereby preventing the seal from sliding on the cable.

The above mentioned objects were accomplished by designing a sealed electrical connector assembly having a front mating face and a rear terminal receiving face, where the housing has at least one terminal receiving passageway extending forwardly from the rear face. The housing further comprises a rear cable receiving section extending from the rear face, where the cable receiving section comprises a transverse groove therein. An electrical terminal is disposed in the passageway, where the terminal is electrically connected to a conductor of an insulated wire. A sealing grommet is slidably received over the outer insulation of the insulated wire, and the grommet comprises a forward annular rib and rearward annular ribs. The insulated wire is positioned in the rear cable receiving section with the forward annular rib placed in the transverse groove. A retention member is moveable to a position remote from the rear cable receiving section, to a position latched over the rear cable receiving section, and which comprises gripping arms which when in the locked position, surround the forward annular rib, thereby compressibly retaining the seal in place.

The preferred embodiment of the invention will now be described by way of reference to the drawing figures, where:

Figure 30:
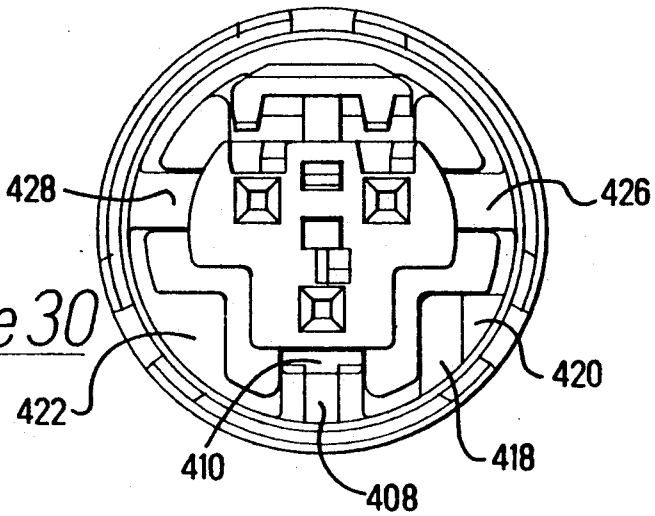
Figure 29:
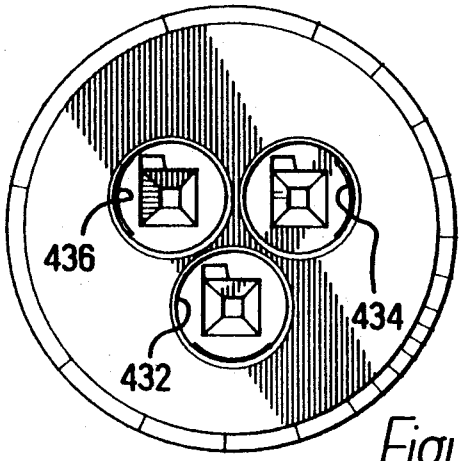
FIG. 29 is a rear plan view of the shell as shown in FIG. 28, less the terminals.
Figure 31:
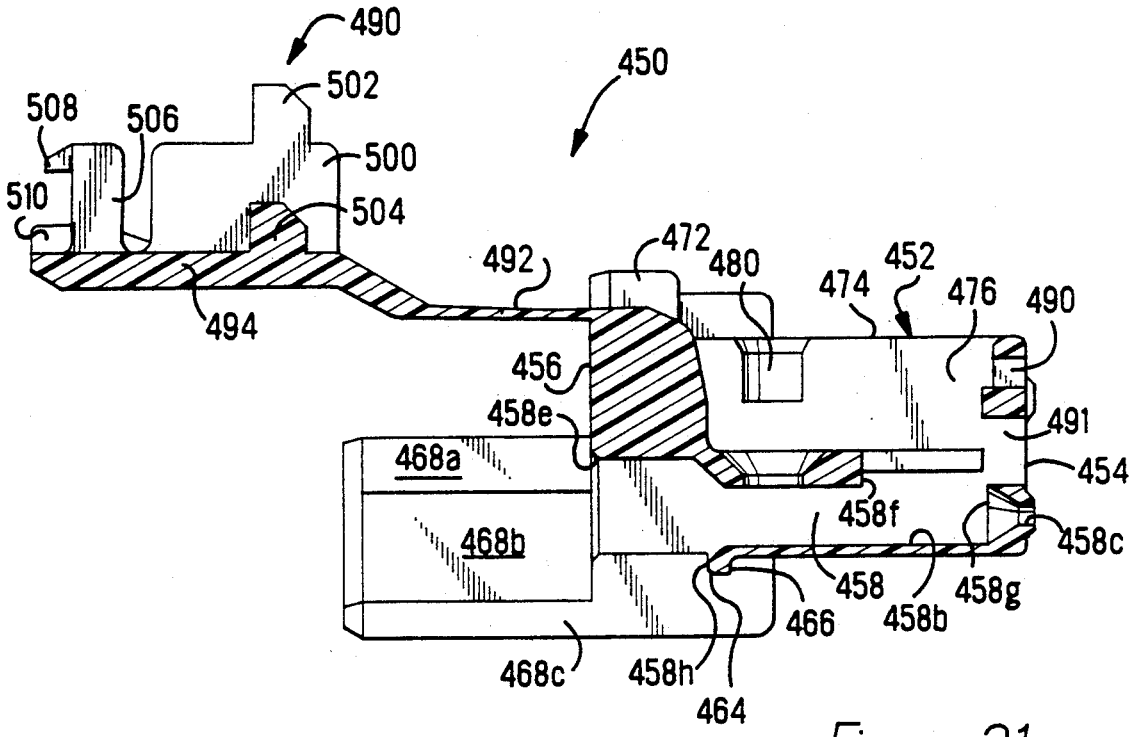
Figure 32:
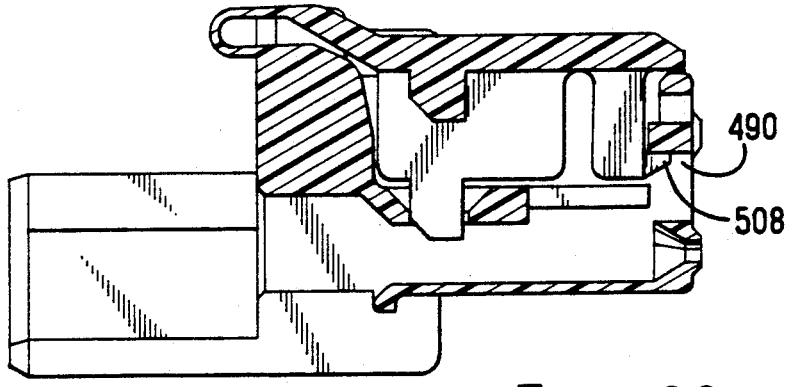
Figure 34:
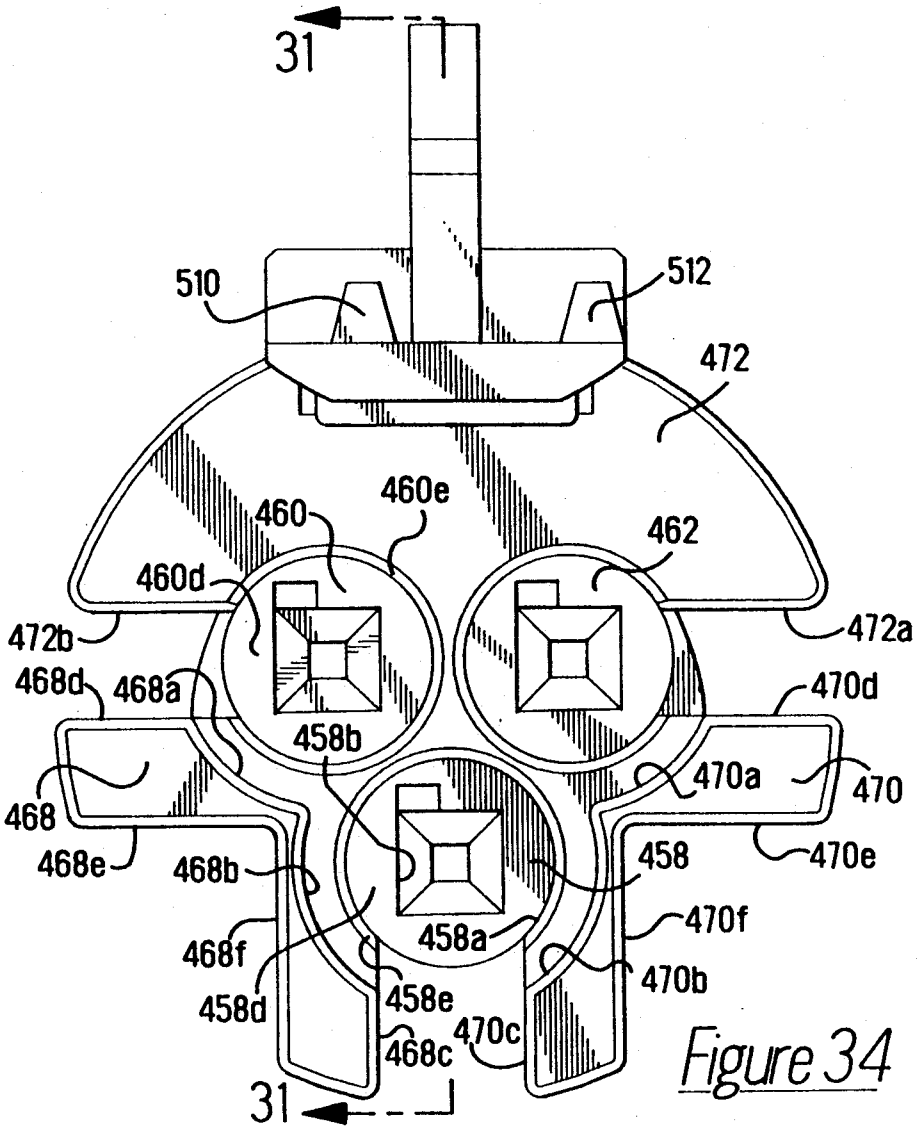
Figure 33:
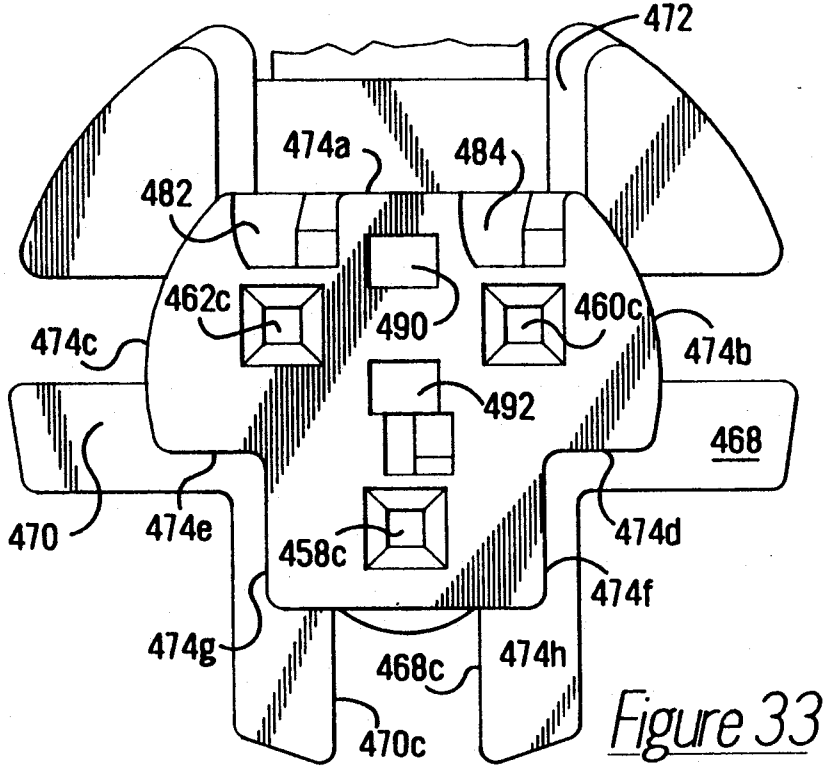
Figure 36:
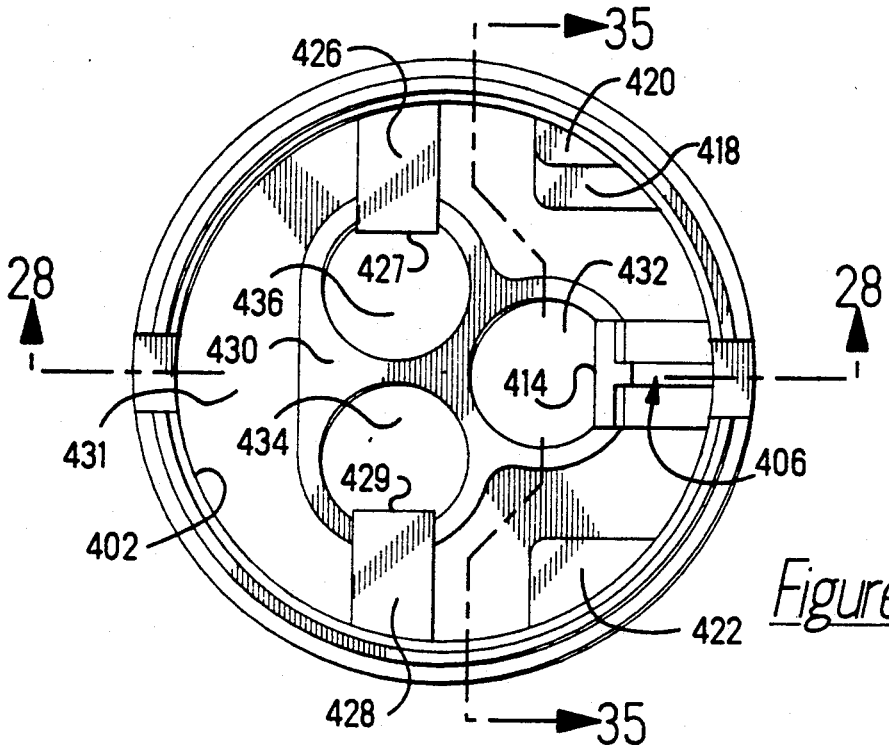
Figure 35:
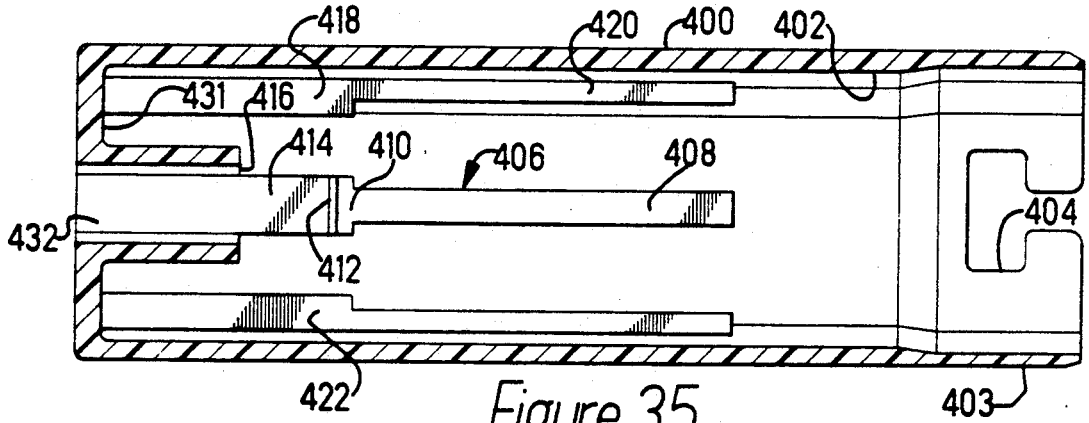

FIG. 30 if a front plan view of the shell of FIG, 28, less the terminals;

FIG. 31 is a cross-sectional view of the pin housing insert through lines 31—31 of FIG. 34;

FIG. 32 is a cross-sectional view similar to that of FIG. 31 showing the secondary retention mechanism in a latched position;

FIG. 33 is a front plan view of the pin housing insert;

FIG. 34 is a rear plan view of the pin housing insert;

FIG. 35 is a cross-sectional view of the outer shell member through lines 35—35 of FIG. 36;

FIG. 36 is an end view of the shell member shown in FIG. 35 looking in from the front.

Figure 37:
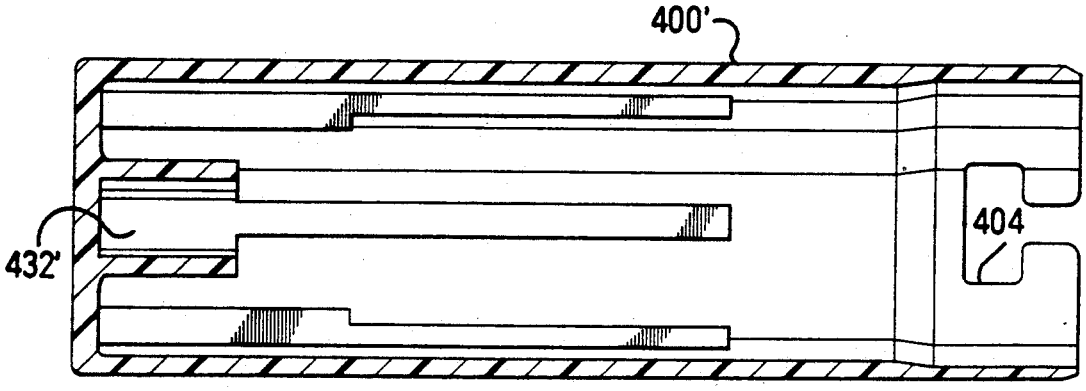
Figure 38:
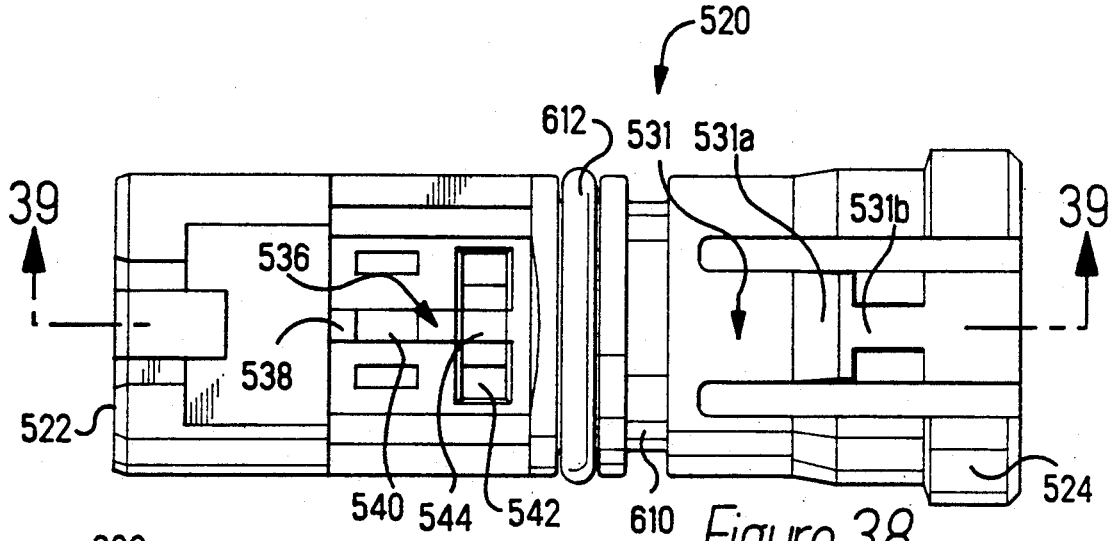
Figure 39:
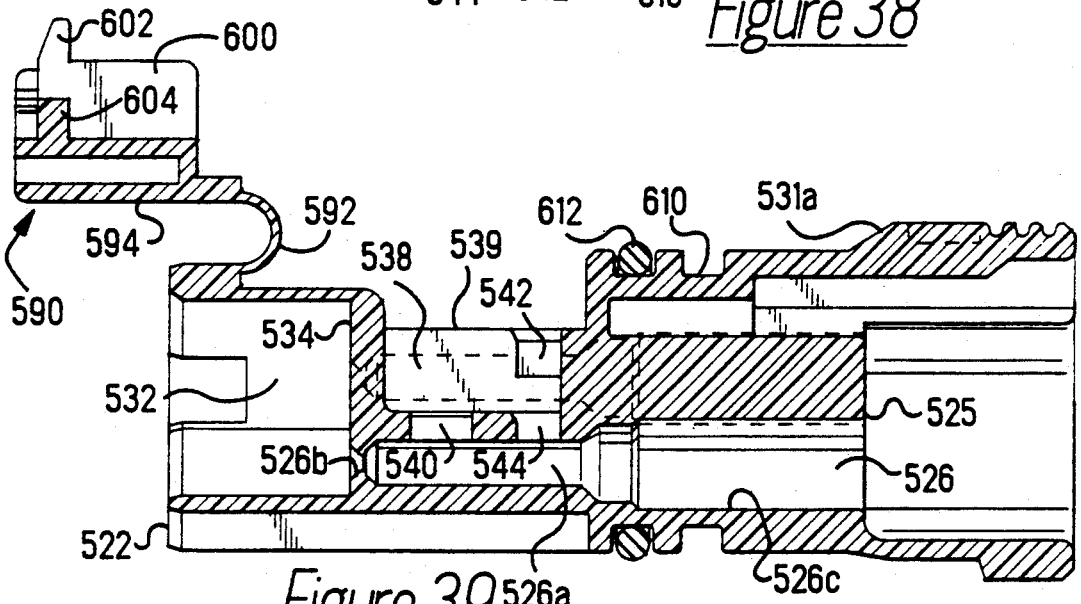
Figure 40:
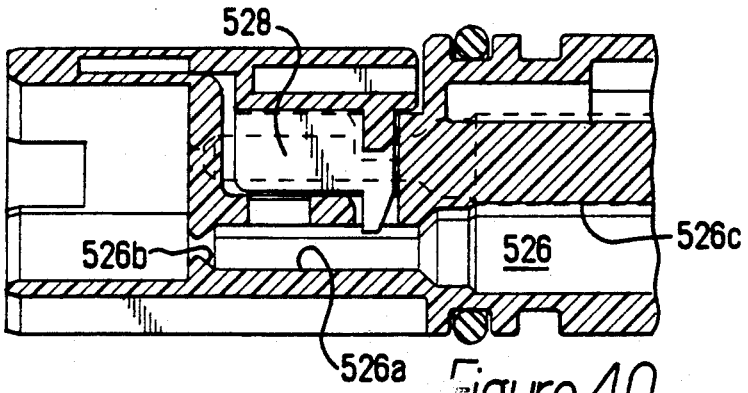
Figure 41:
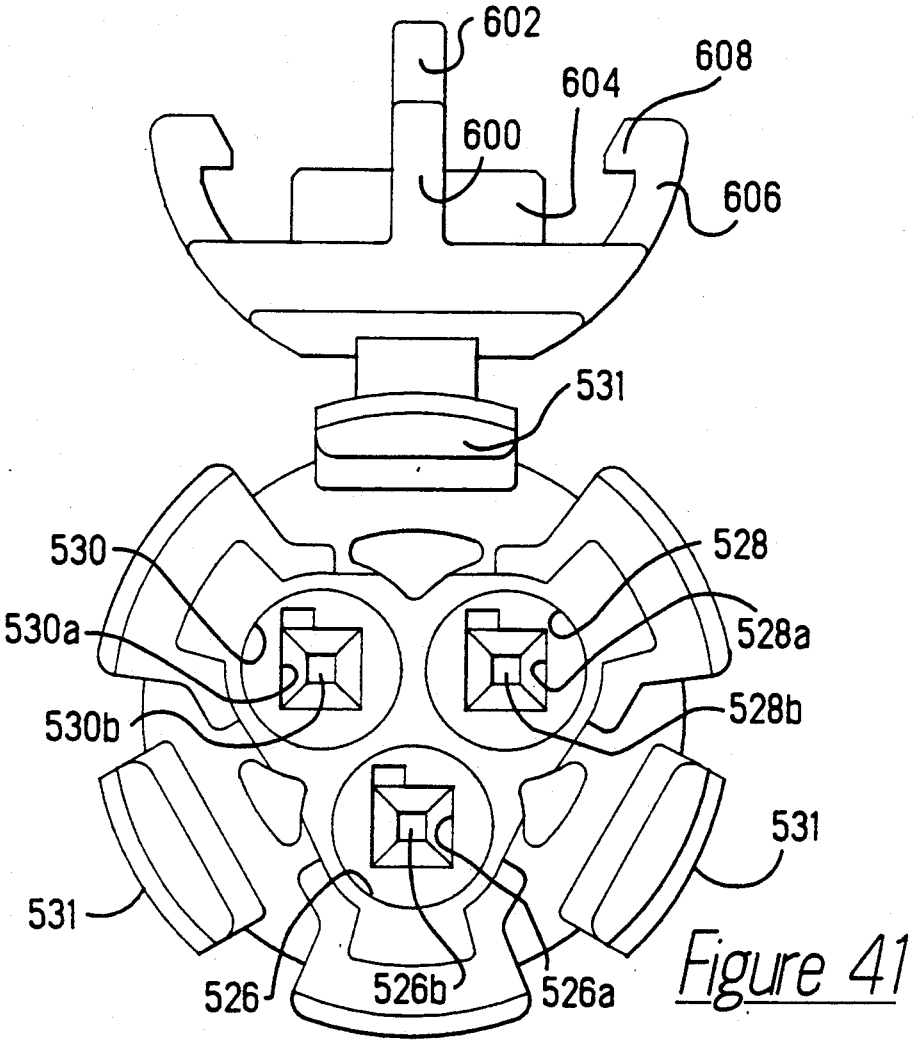
Figure 42:
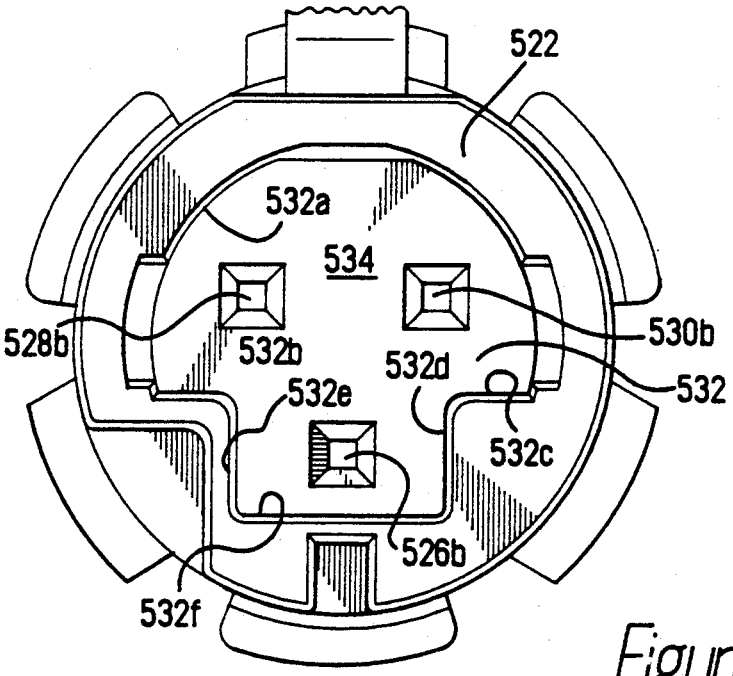
Figure 43:
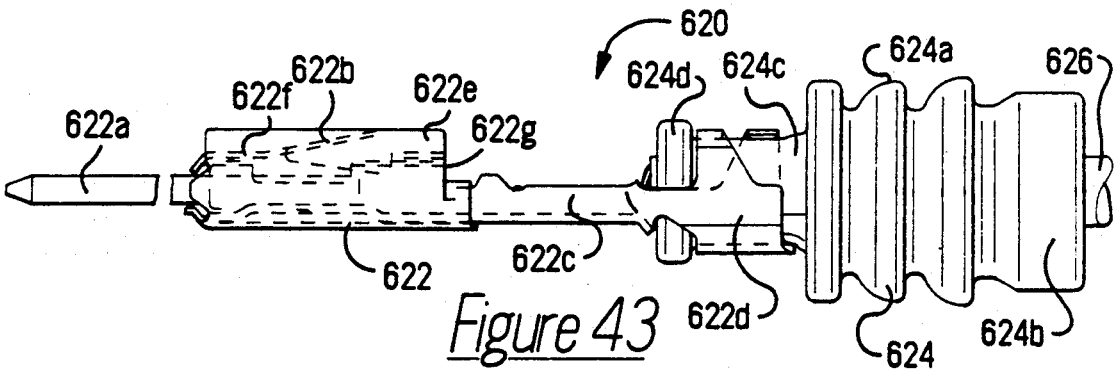
Figure 44:
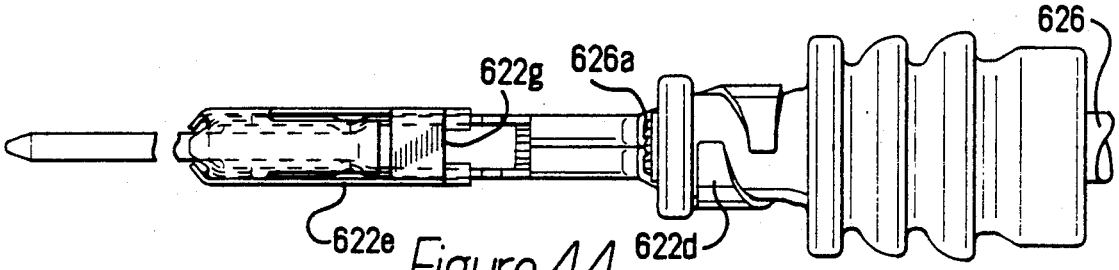
Figure 45:
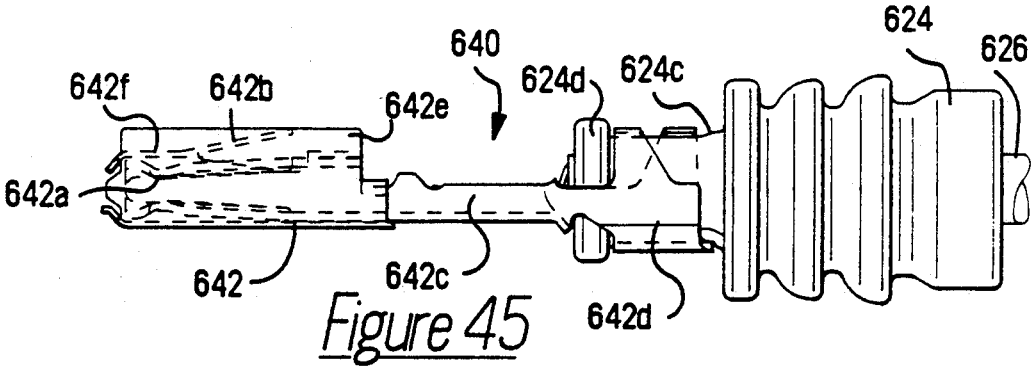
Figure 46:
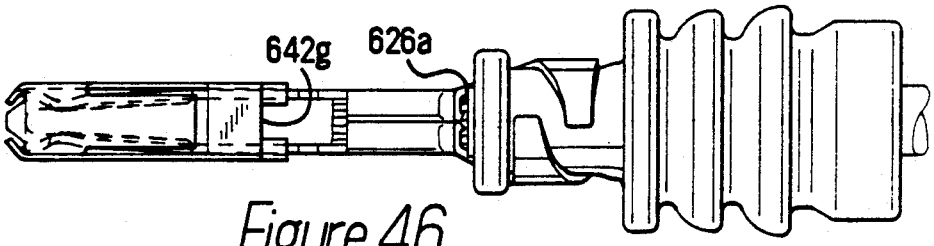

FIG. 37 shows an alternate embodiment of a shell member for a two position connector;

FIG. 38 is a top plan view showing the socket housing;

FIG. 39 is a cross-sectional view through lines 39—39 of FIG. 38;

FIG. 40 is a partial cross-sectional view similar to that of FIG. 39 showing the secondary retention mechanism in a latched condition;

FIG. 41 is a rear plan view of the socket housing;

FIG. 42 is a front plan view showing the socket housing;

FIG. 43 is a side plan view showing the pin member shown in an assembled manner;

FIG. 44 is a top plan view similar to that of FIG. 43;

FIG. 45 is a side plan view showing the socket member shown in an assembled manner; and FIG. 46 is a top plan view similar to that of FIG. 45.

Figure 1:
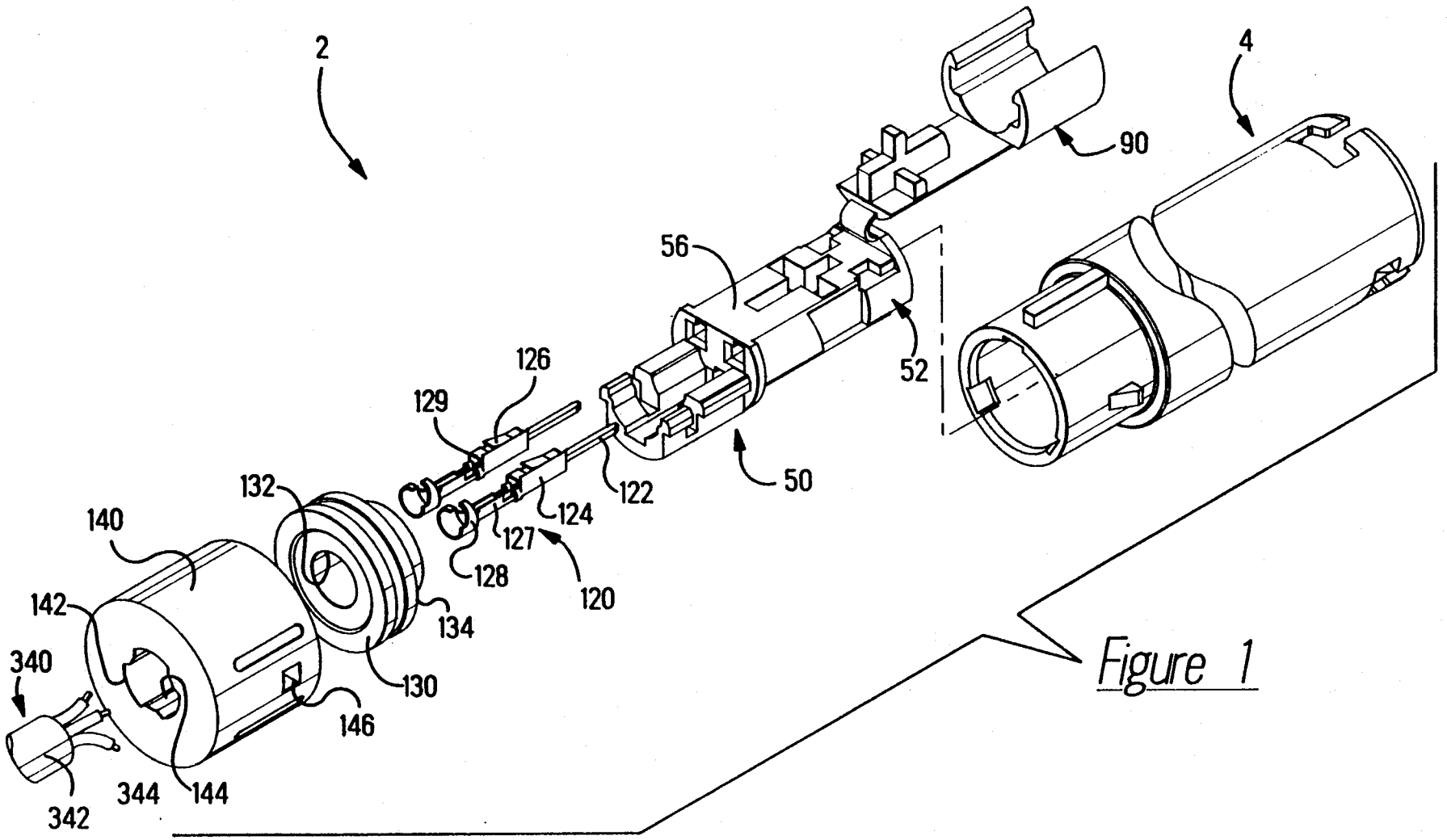
FIG. 1 is an isometric view showing the components of the pin receptacle assembly exploded away from one another.
Figure 3:
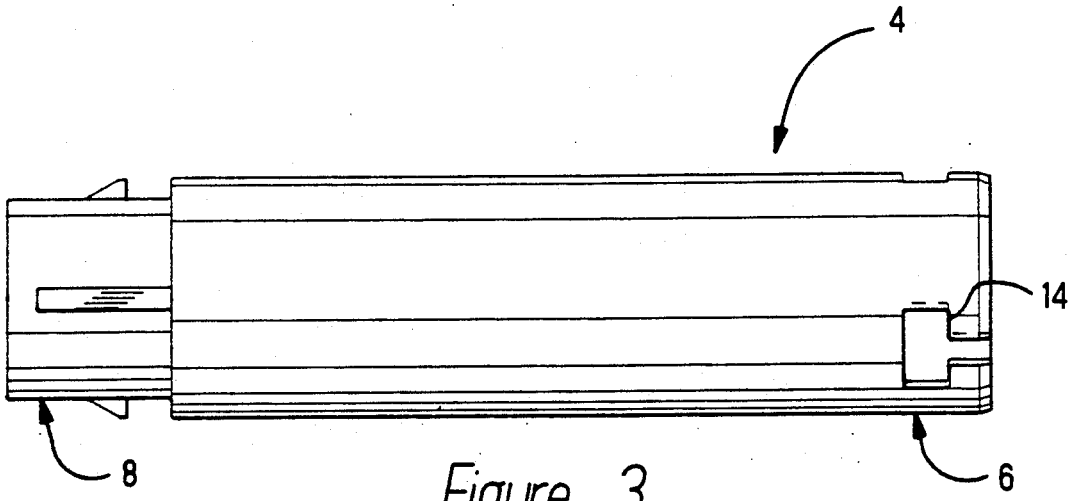
FIG. 3 is a plan view of the outer shell shown in FIG. 1.
Figure 4:
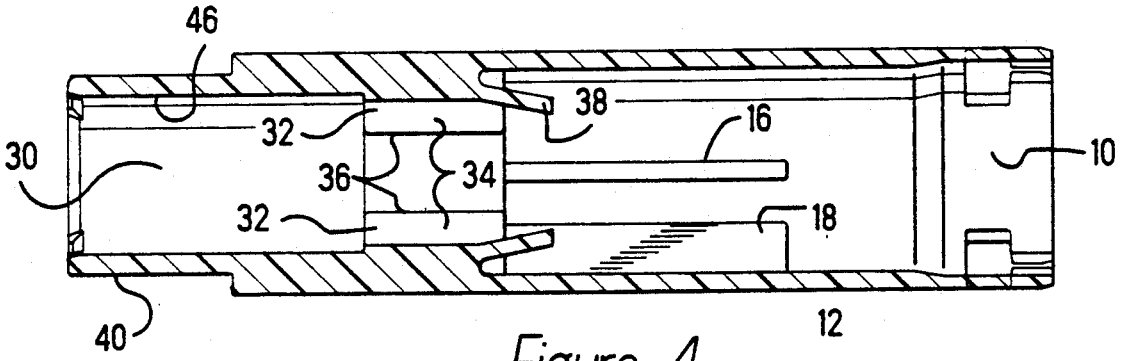
FIG. 4 is a cross-sectional view of the outer shell of FIG. 3.
Figure 5:
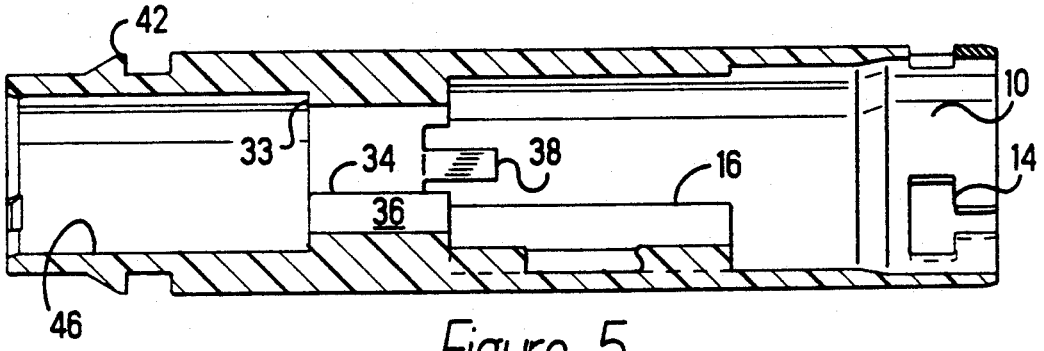
FIG. 5 is a cross-sectional view of the outer shell shown in FIG. 3.

With reference first to FIG. 1, the receptacle assembly includes an outer housing 4, an inner pin housing 50, a plurality of pins 120, a rear wire sealing grommet, and a rear cap 140. With reference now to FIGS. 3–5, the outer shell 4 includes a front mating end 6 and a rear wire receiving end 8. The front mating end 6 includes an opening 10 having an inner bore 12. The front mating end 6 also includes T-slots 14 at the front edge thereof which provides for mating latching with a complementary connector. Formed integrally with the inner bore 12 of the housing 4 is a key bar 16 and a key wedge 18.

As shown in FIG. 4, the rear wire receiving end 8 includes a wire opening 30 which extends inwardly from an end of the housing 4. Two keying wedges 32 are also found on the interior of the housing 4 having top surfaces 34 and side surfaces 36. Latches 38 are integral with the inner shell and extend forwardly towards the front mating end 6 of the shell 4. The wire receiving end 8 includes an outer diameter 40 having a plurality of latching lugs 42 on the outer surface thereof.

Figure 6:
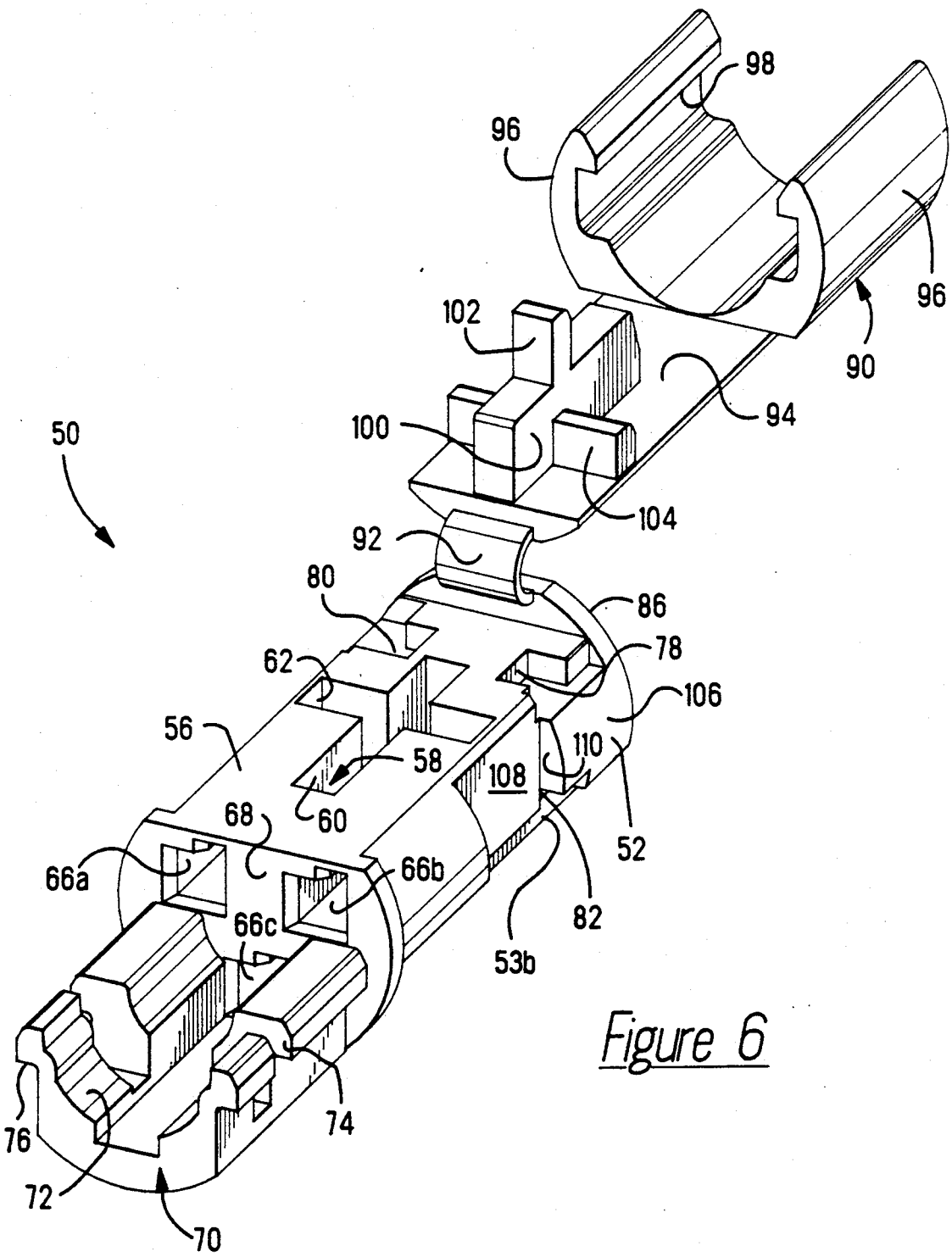
FIG. 6 is an enlarged view of the pin housing shown in FIG. 1.

With reference now to FIG. 6, the pin housing 50 comprises a central body section 52 having an integral flexible latch 90 interconnected to the central body section 52 via a web section 92. The central body section 52 comprises a rear wall 68 and an upper wall 56. Three terminal receiving passageways 66*a*, 66*b* and 66*c* extend forwardly from the rear face 68 towards the front face 86. As shown in FIG. 6, a cross-shaped opening 58 extends downwardly from the upper surface 56 towards the terminal receiving passageways. The cross-shaped opening 58 comprises an axial slot 60 and a transverse slot 62. The axial slot portion 60 extends downwardly from the upper surface 56 and is situated intermediate the two upper terminal receiving passageways 66*a* and 66*b*.

Figure 8:
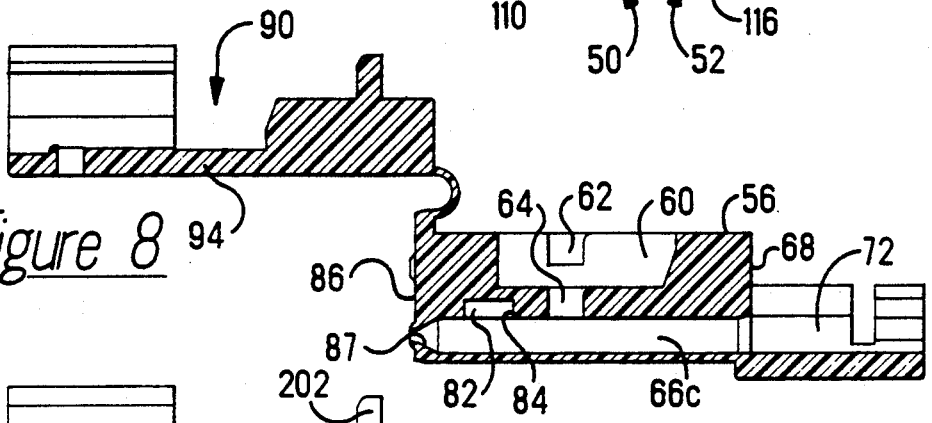
FIG. 8 is a cross-sectional view of the pin housing of FIG. 7 through the axial center-line of the housing.
Figure 9:
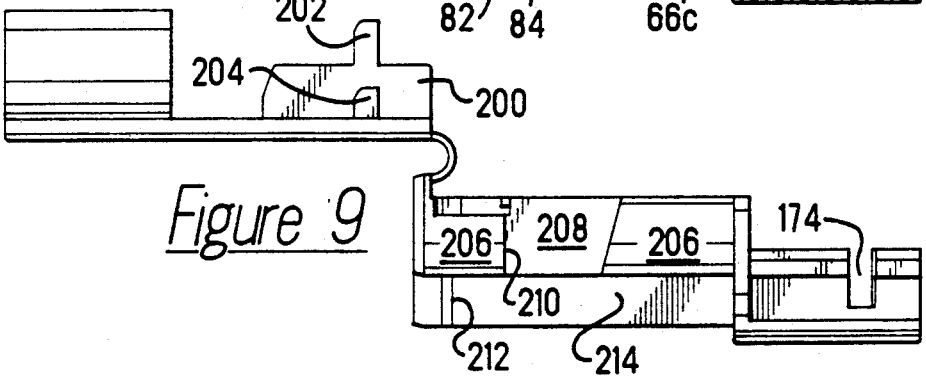
FIG. 9 is a side plan view of the receptacle housing.
Figure 10:
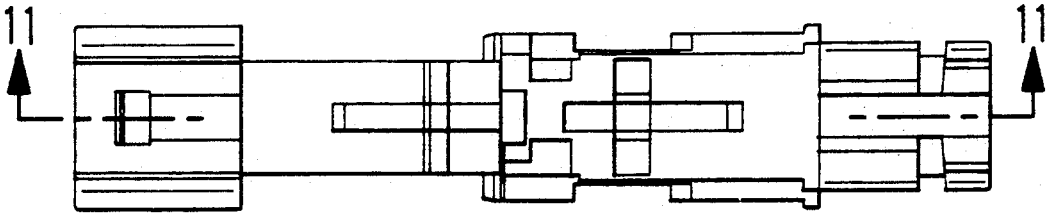
FIG. 10 is a top plan view of the receptacle housing.
Figure 11:
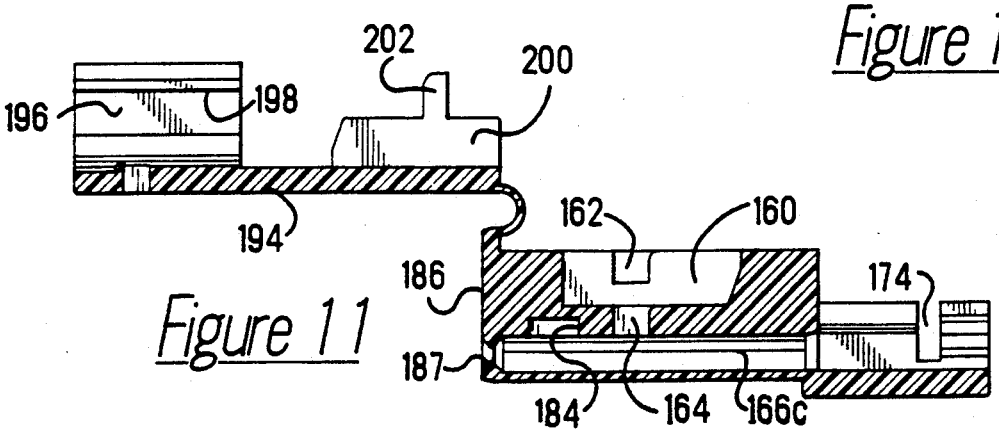
FIG. 11 is a cross-sectional view of the receptacle housing through lines 11—11 of FIG. 10.
Figures 12, 13:
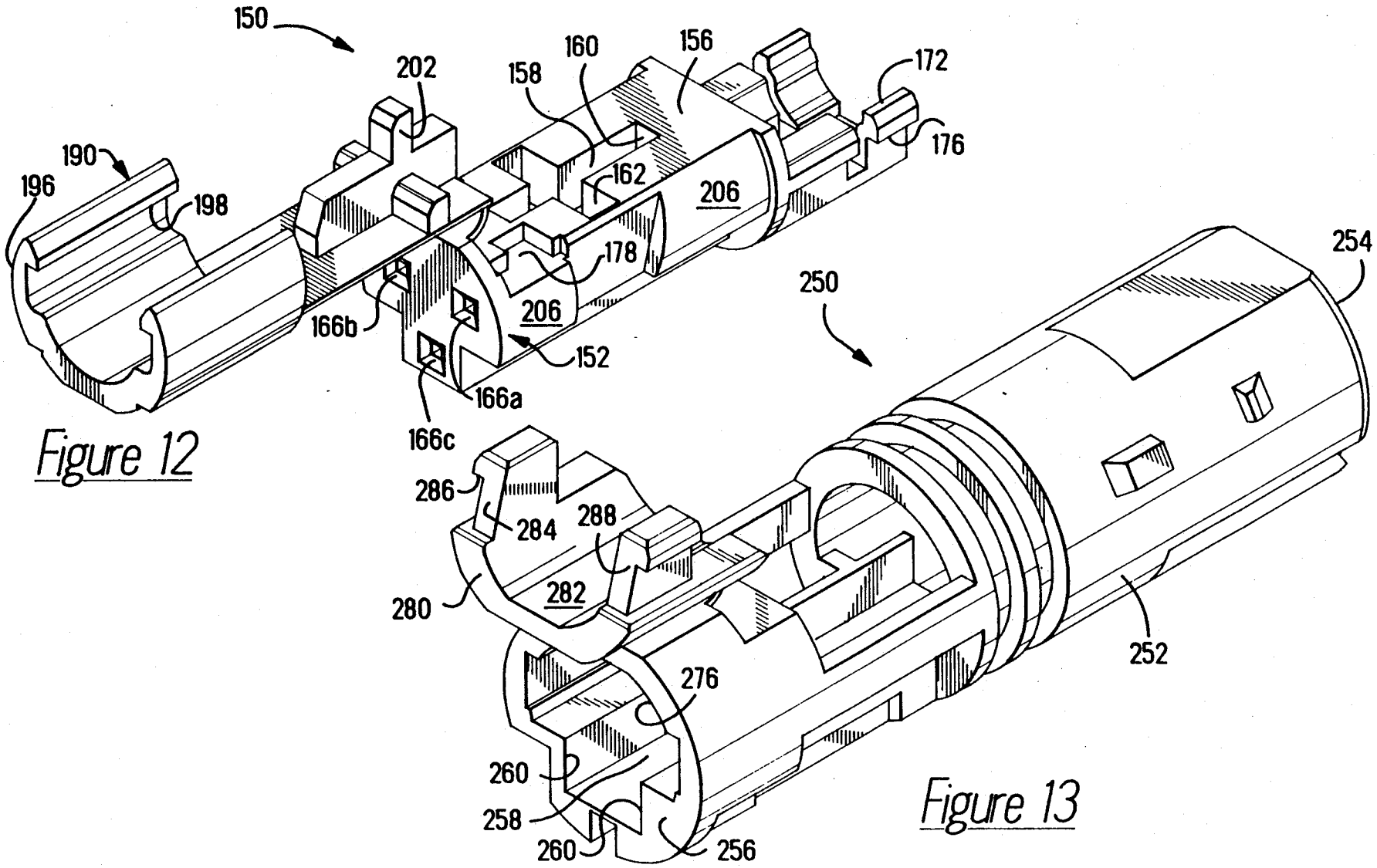
FIG. 12 is an isometric view of the receptacle housing of FIGS. 9–11.
FIG. 13 is an isometric view of the outer socket housing.

As shown in FIG. 8, a vertical passageway section 64 extends from the axial slot 60 and intersects and communicates with the axial terminal receiving passageway 66*c*. The transverse slot 62 extends downwardly from the upper surface 56 and intersects with both of the upper terminals passageways 66*a* and 66*b*. As best shown in FIG. 6, three apertures 78, 80 and 82 extend into the central body section and are formed by side draw mold dies, such that retraction thereof forms a latch shoulder. Each of the apertures 78, 80 and 82 intersects with one of the terminal receiving passageways, for example, aperture 78 intersects with terminal passageway 66*b*, aperture 80 intersects with passageway 66*a* and aperture 82 intersects with the terminal passageway 66*c*. As best shown in FIG. 8, aperture 82 intersects at the upper edge of the terminal passageway to provide a rear latching surface 84. While the rear latching surfaces formed by apertures 78 and 80 are not shown, they are similar in nature to the rear latching surface 84 shown in FIG. 8.

Also extending from the rear face 68 is a cable receiving section 70 which is formed by a substantially U-shaped wire nest 72. A slot 74 intersects the cable receiving nest in a transverse direction to the nest. On the outer surfaces of the wire nest, are downwardly facing latching surfaces 76.

The pin housing 50 also includes an integral latch member 90 which comprises a wall 94 having two semicircular gripping arms 96 extending therefrom at the end of the wall 94. Each of the arms 96 includes a latching surface 98. At the forward section of the wall 94 is an axial bar section 100 having a vertical peg 102 extending therefrom. A transverse bar 104 extends crosswise to the axial bar and is also integral with the wall 94.

The central body section 52 of the pin housing 50 is generally arcuately shaped as defined by surfaces 106. Intermediate the arcuate wall sections is a cut out section 108 which defines a rearwardly facing latch surface 110.

With reference again to FIG. 1, the receptacle assembly further comprises a plurality of pin members 120 including central body sections 124 having a rearwardly extending retention arm 126 extending from the central body section. The pin members also include the forwardly extending pin section 122 and rearwardly extending crimp sections 127. The assembly also includes a grommet 130 as shown in FIGS. 1 and 2 as including an internal bore 132 and a forward rib section !36 and a rearward set of ribs 134, where the rib 136 and the ribs 134 are spaced apart by a reduced diameter section 138.

A rear cap 140 is also included having a cable receiving opening 142 where the opening 142 has a plurality of stabilizing rib sections 144 integral with the opening 142. Around the periphery of the cap at the forward end thereof are apertures 146 equal in number with the latching ribs 42 as shown in FIG. 5.

Figure 2:
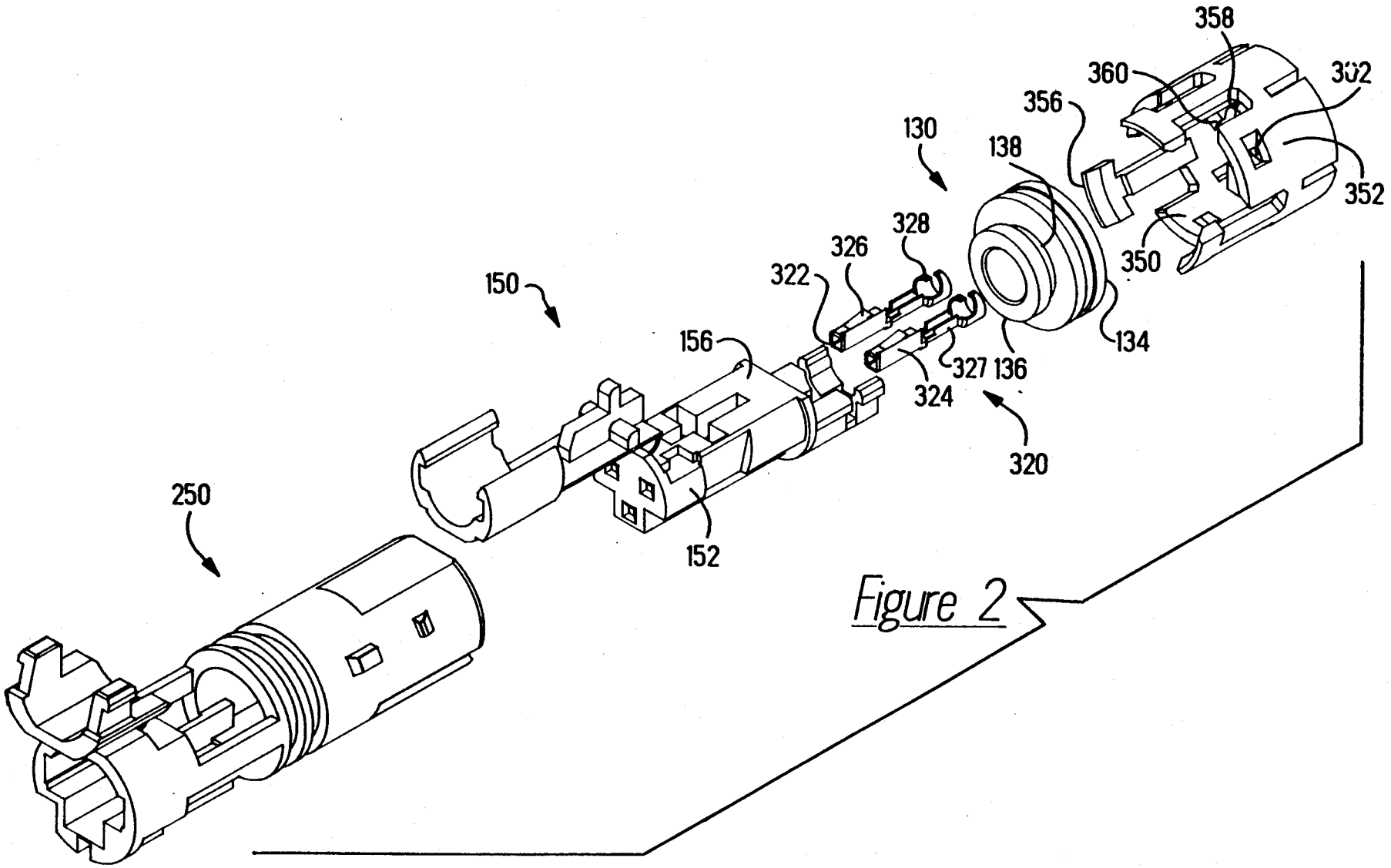
FIG. 2 is an isometric view of the socket assembly showing the components exploded away from one another.
Figure 7:
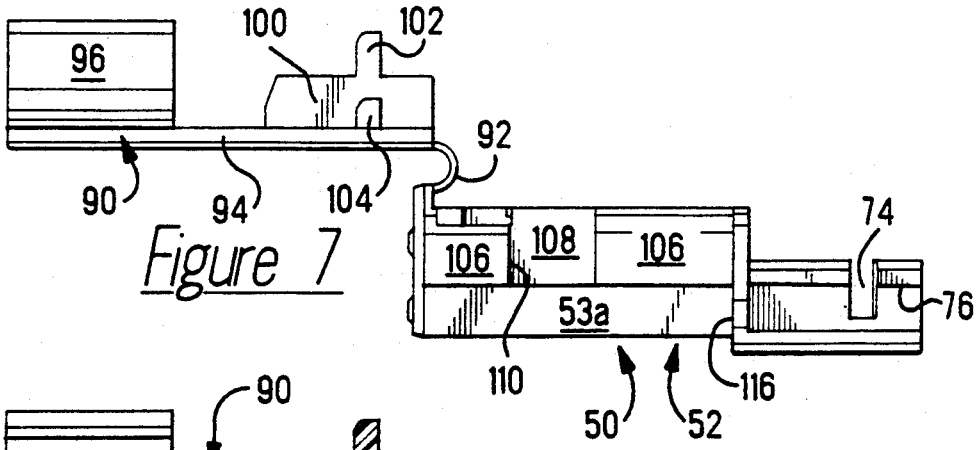
FIG. 7 is a side plan view of the pin housing shown in FIG. 6.

With reference now to FIG. 2, the socket assembly is shown as including an outer housing 250, a socket housing 150, a plurality of electrical socket terminals 320, a rear cable grommet 130 and a rear retention cap 350. A comparison of FIGS. 6 through 8 with FIGS. 9 through 12 show that the pin housing and the socket housing are virtually identical, and therefore only the differences will be shown. Comparing FIG. 8 to FIG. 11 shows that with the pin housing, the front aperture 87 of the terminal passageways forms a dimple on the exterior of the surface 86 whereas the aperture 187 on the receptacle housing forms an indent within the front housing face 186. Furthermore, with respect to FIG. 9, the receptacle housing includes a pair of latching shoulders 212 on either side of the side surfaces 214 which are not included on the pin housing 50.

Figure 14:
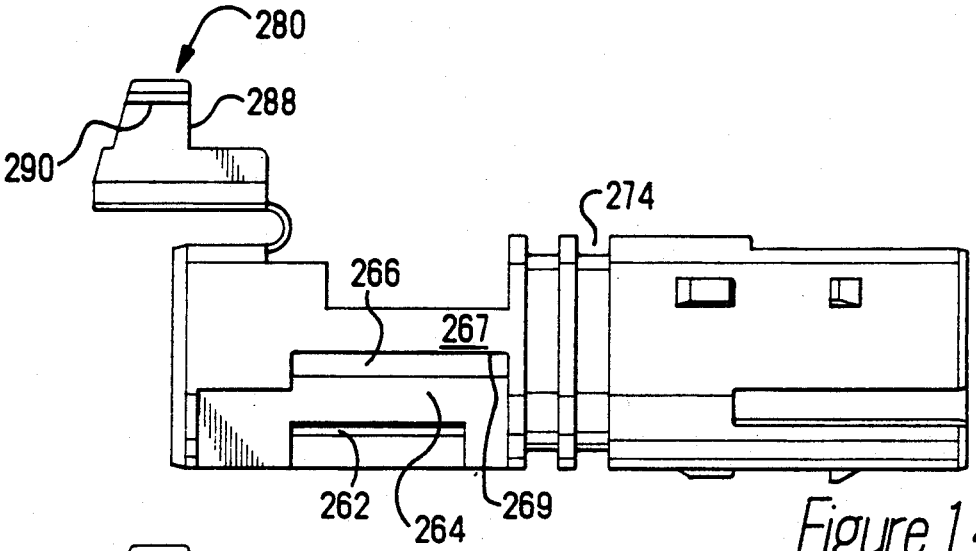
FIG. 14 is a side plan view of the outer socket housing.
Figure 15:
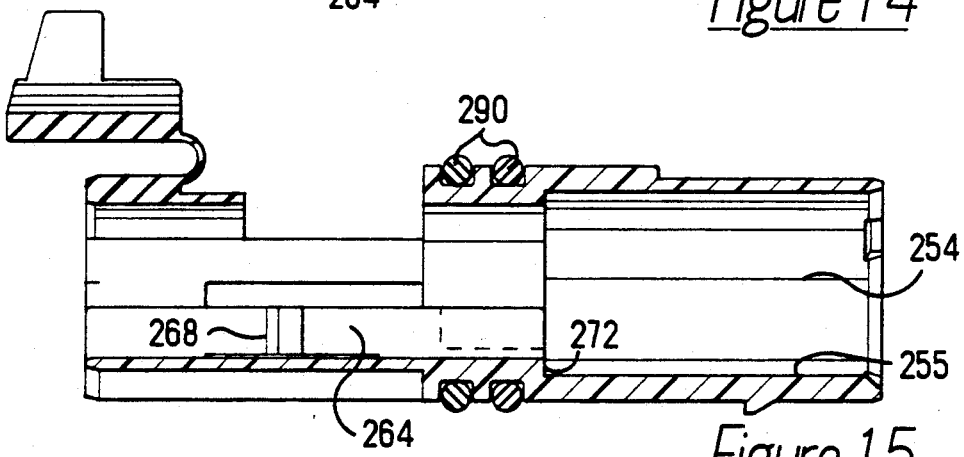
FIG. 15 is a cross-sectional view of the outer socket housing.
Figure 16:
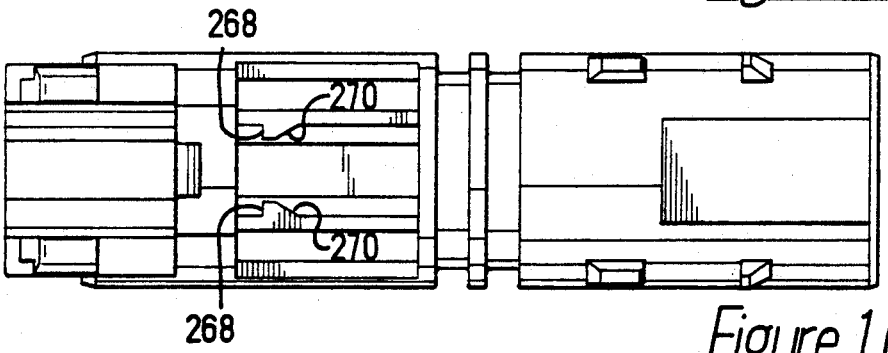
FIG. 16 is a top plan view of the outer socket housing.
Figure 17:
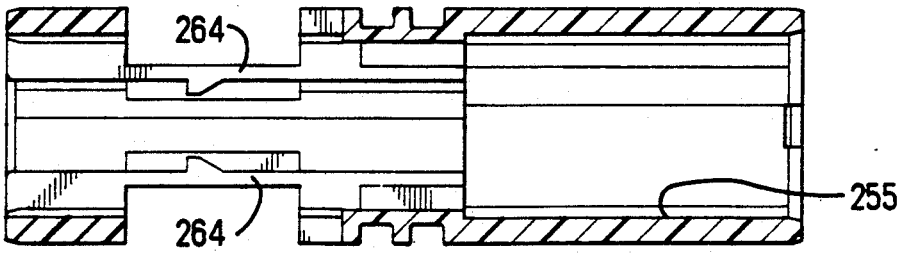
FIG. 17 is a cross-sectional view of the outer socket housing.

With reference now to FIGS. 13–17, the socket outer housing 250 is shown as including a generally cylindrical body 252 having a rear section 254 and a front mating end 256. The rear section includes an inner bore 255 while the front mating end 256 includes an opening 258 having a partially cylindrical surface 276 and parallel sidewalls 260. As shown best in FIG. 14, two apertures 266 and 262 project through the sidewall 252 of the housing 250 to isolate a section 264, to provide for its flexibility. As shown in FIG. 15, the arm 164 includes a latch member on its inner surface having a forwardly facing latching surface 268 and as shown in FIG. 16 a ramp surface 270.

With reference again to FIG. 2, the receptacle contacts 320 include a central section 324, a pin receiving section 322 and a resilient retention arm 326 extending from the central portion 324. Rearward of the central portion 324 is a crimp contact section 327 and a strain relief section 328. Also shown in FIG. 2 is the rear retention cap 350 having a rear section 360 and a cylindrical portion 352. A cable receiving opening 358 extends through the section 362 while resilient latch arms 356 extend from the cylindrical portion 352.

Figure 18:
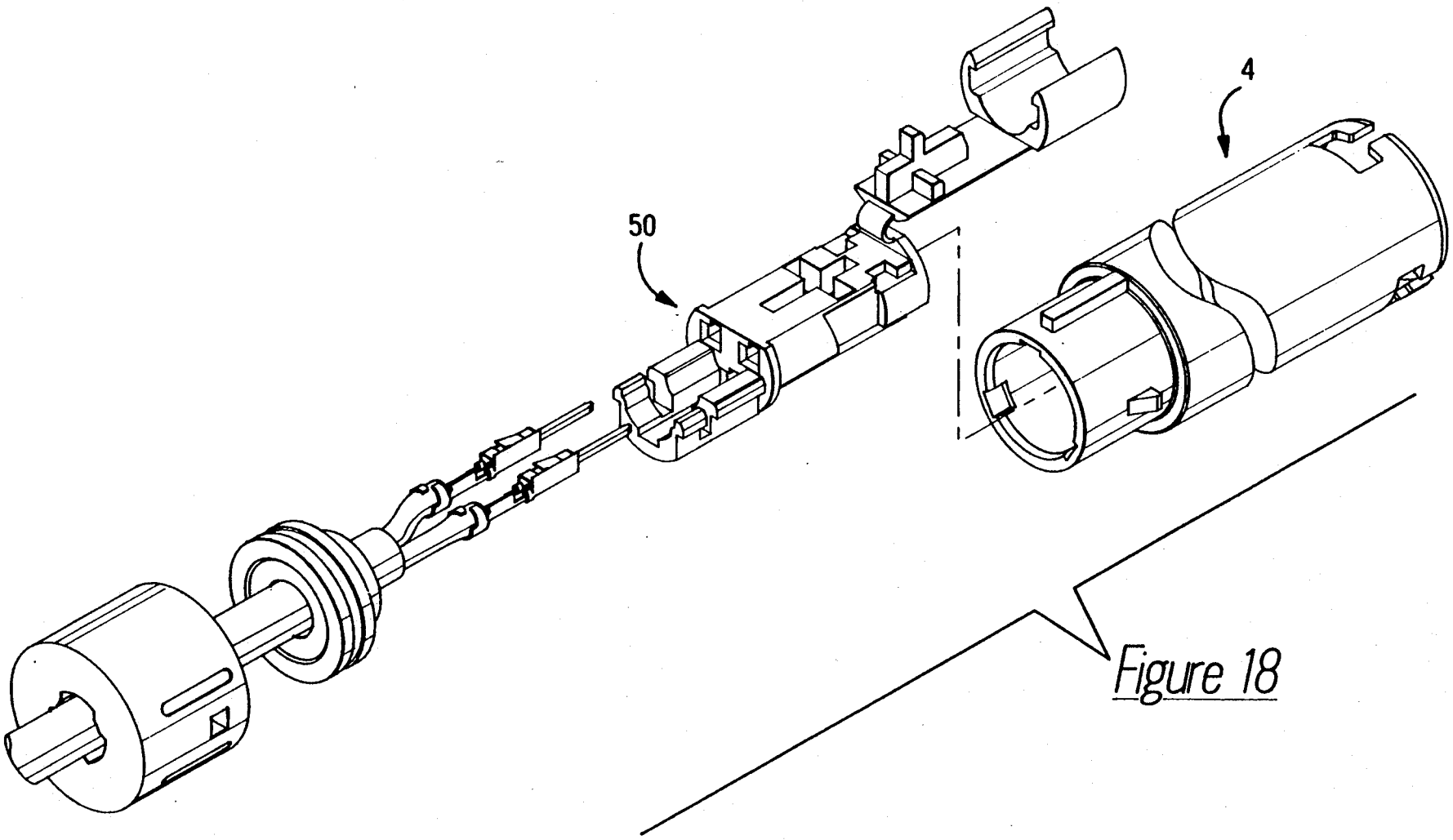
FIGS. 18–22 are isometric views showing the assembly of the receptacle assembly.

To assemble the pin connector assembly shown in FIG. 1, the three conductor cable 340 is fed through the rear opening 142 of the clamp 140 and through the inner bore 132 of the grommet 130. The individual cables insulator conductors 344 are then stripped and placed into the crimping sections 127 of the individual terminals and crimped in place. At the same time, the strain relief arms are wrapped around the insulation section of the cable to provide for a strain relief, as shown in FIG. 18. The terminals may now be moved forwardly into the individual terminal passageways **66*a*, 66*b* and 66*c* until the resilient retention arms 126 snap in place in front of their respective latching shoulders, for example, against surface 84 as shown in FIG. 8 The resilient arm 126 against the rear shoulder 84** provides for the primary retention of the terminals within their respective passageways.

Figure 19:
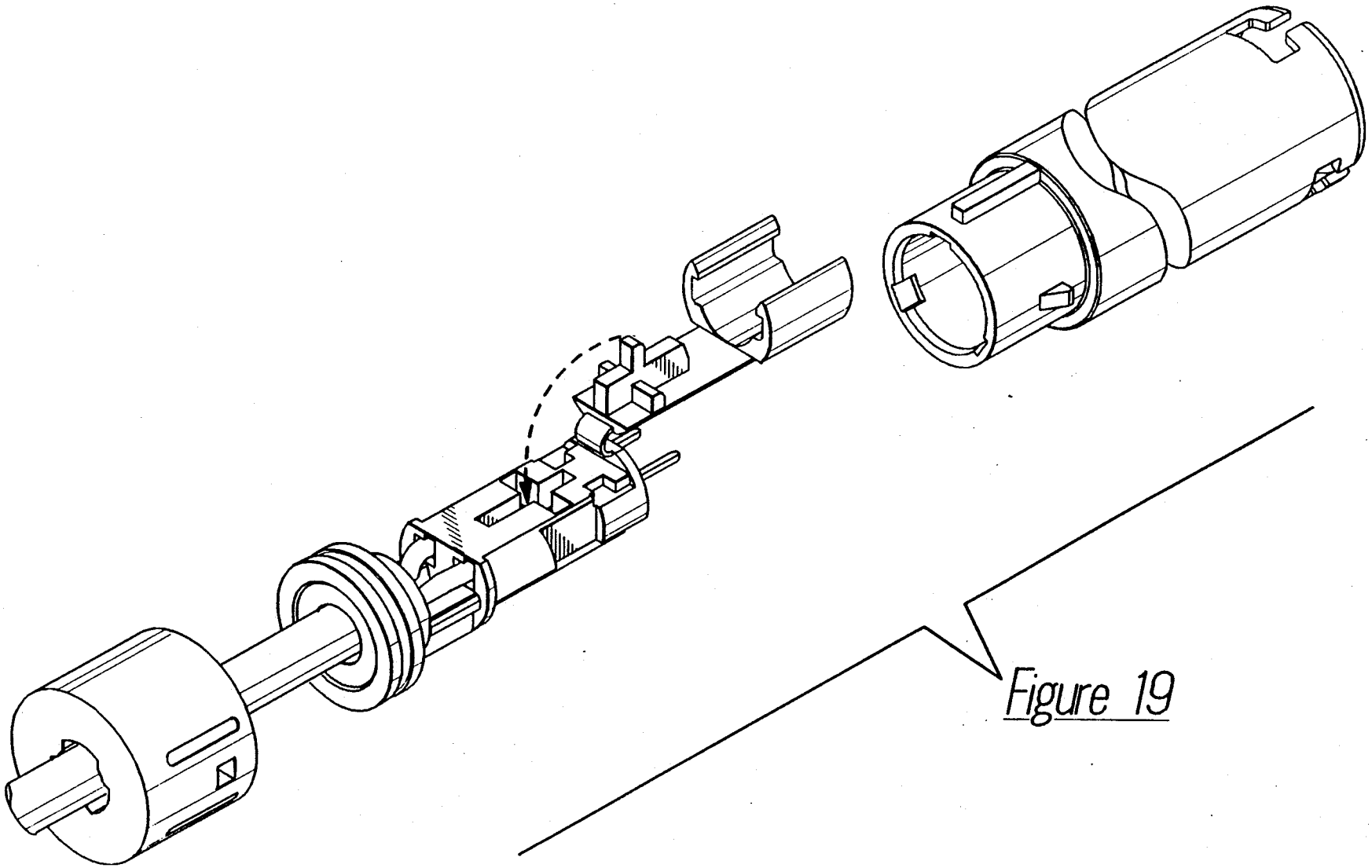
Figure 20:
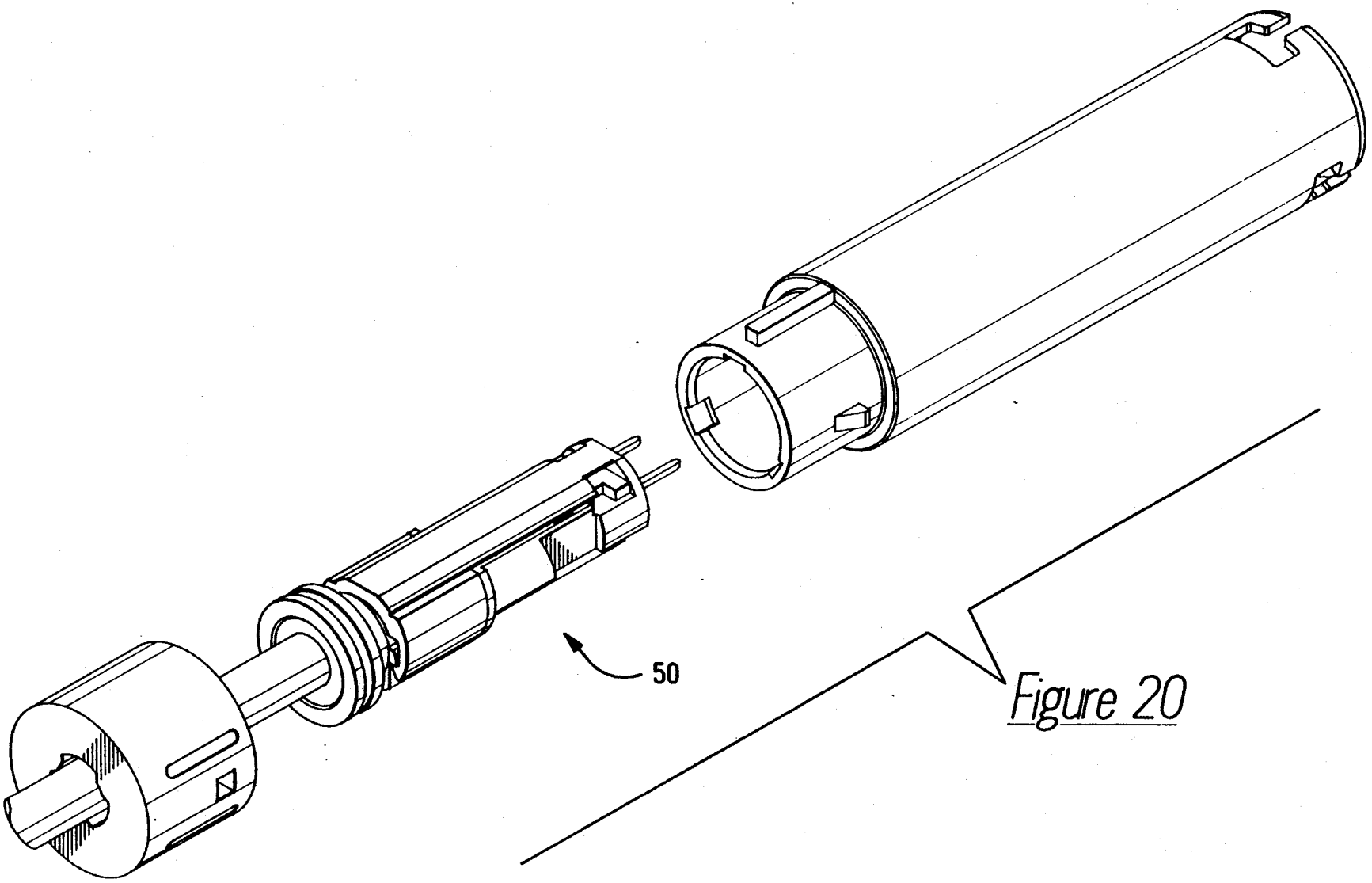

With the terminals in their respective passageways, the grommet 130 can be slideably placed in the axial disposition along the cable such that the front rib 136 (FIG. 2) of the grommet lies within the transverse slot 74 in the cable nest (FIG. 6) as shown in FIG. 19. The resilient latch member 90 is now rotated to a closed position as shown in FIG. 19 to the position where the latch shoulders 98 and 76 (FIG. 6) and retain the latch member 90 in a closed position When in this position, the gripping arms 96 retain the grommet 130 in its axial position, and also slightly compresses the forward section of the grommet around the outer jacket 342 of the cable.

Also, when the resilient latch member 90 is rotated into its latched position, the axial bar 100 provides for secondary retention of the terminals within their respective passageways. In other words, the transverse bar 104 is profiled to be received within the transverse slot 62 such that the transverse bar is locked in place behind and below the rear edges 129 (FIG. 1) on the electrical terminals, which are in the passageways **66*a* and 66*b*. With respect to the electrical terminal which is in passageway 66*c*, the locking peg 102 (FIG. 6) is received within the vertical aperture 64 (FIG. 8) and further into the terminal passageway 66*c* such that the peg 102 is behind the rear edge 129 of the terminal which is located within passageway 66*c*. The assembled housing 50 may now be inserted into the rear of the outer housing portion 4** until the housing is locked into place.

The housing 50 is inserted forwardly into the outer shell section 4 until the forwardly facing shoulder 116 (FIG. 7), abuts the rear face 33 (FIG. 5) of the outer shell. At this time the resilient latch members 38 will lock into the aperture at 108 (FIG. 6) and behind surfaces 110. It should be noted that the side surfaces **53*a* and 53*b* (FIGS. 6 and 7) are profiled to fit between the surfaces 36 (FIGS. 4 and 5) of the inner portion of the shell. When in this position, the rear section of the shell is sealed as the outer diameter of the ribs 134 of the grommet 130 are larger in diameter than the inside diameter of the bore 12 (FIG. 4) such that movement of the connector assembly 50 into the outer housing 4 provides for a sealed assembly The rear cap 140 is now moved forwardly until the locking apertures 146 snap into place over the locking members 42, as shown in FIG. 21, to a final assembly as shown in FIG. 22**.

With respect now to FIGS. 23–27, the assembly of the socket housing will be shown by first placing the cable 340 through the rear cap 350 and through the grommet 130. The individual conductors 344 may now be prepared and crimped within the crimp contact sections 327 of the terminals 320. The terminals are now placed into their respective passageways **166*a*, 166*b* and 166*c* such that the retention arms 326 of the terminals 320 latch in place against their respective latching shoulders within the apertures 166*a*–166*c*. The grommet 130 is slid forwardly with the forward rib 136 placed within the transverse slot 174. The resilient latch arm 190 is rotated in a similar manner as that latch arm 90, and the latch arm 190 is locked in place by the latching surfaces 176 and 198. Once again the secondary retention operates in a duplicate manner whereby the transverse bar 204 retains the terminals in passageways 166*a* and 166*b* whereas the vertical lug section extends into the vertical section 164 to retain the terminal situated in terminal passageway 166*c*. The socket housing 150 may now be moved into the rear of the outer housing 250 with the lower parallel surfaces 240 aligned with the inner parallel surfaces 260 of the outer housing 250**.

Figures 26, 27:
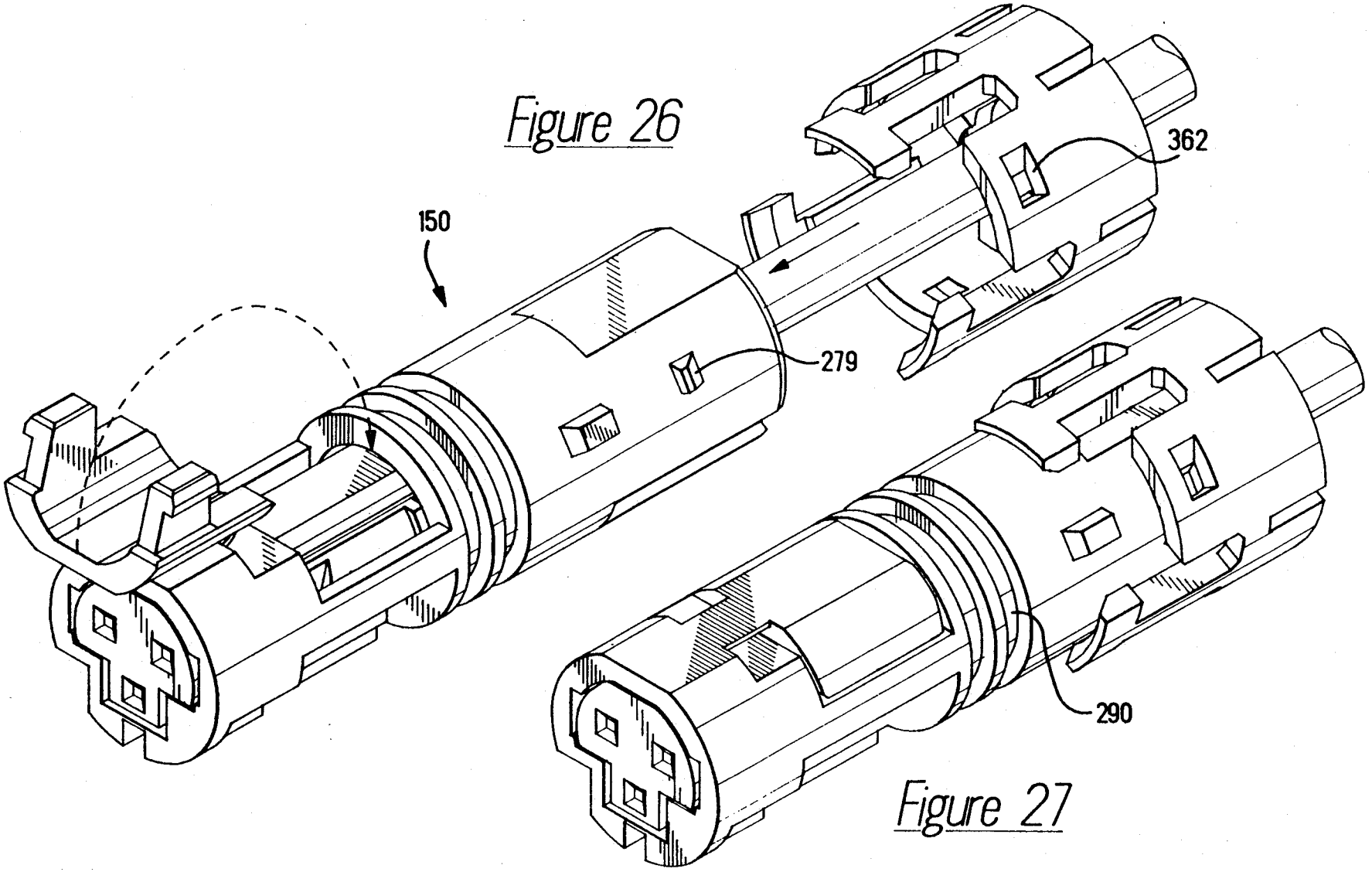

The socket housing 150 is moved forwardly until the latching surface 212 (FIG. 9) is locked in place behind the latching surfaces 268 (FIG. 15) on the flexible side arms 264. The flexible latch member 280 may now be rotated into position as shown in FIG. 26 until the latching shoulder 290 (FIG. 14) latches beneath the downwardly facing shoulder 269 of the arm 267 (FIG. 14). When in this position, the arms 284 (FIG. 13) of the latch member 280 reside within the side apertures 208 (FIG. 9) of the housing and the forwardly facing shoulder 288 (FIG. 14) is adjacent to the rearwardly facing shoulder 210 FIG. 9) of the housing which retains the housing in place. The rear cap 350 may now be moved forwardly toward the housing 150 until the apertures 362 are latched in place on the lugs 279 as shown in FIGS. 26 and 27.

Figures 21, 22:
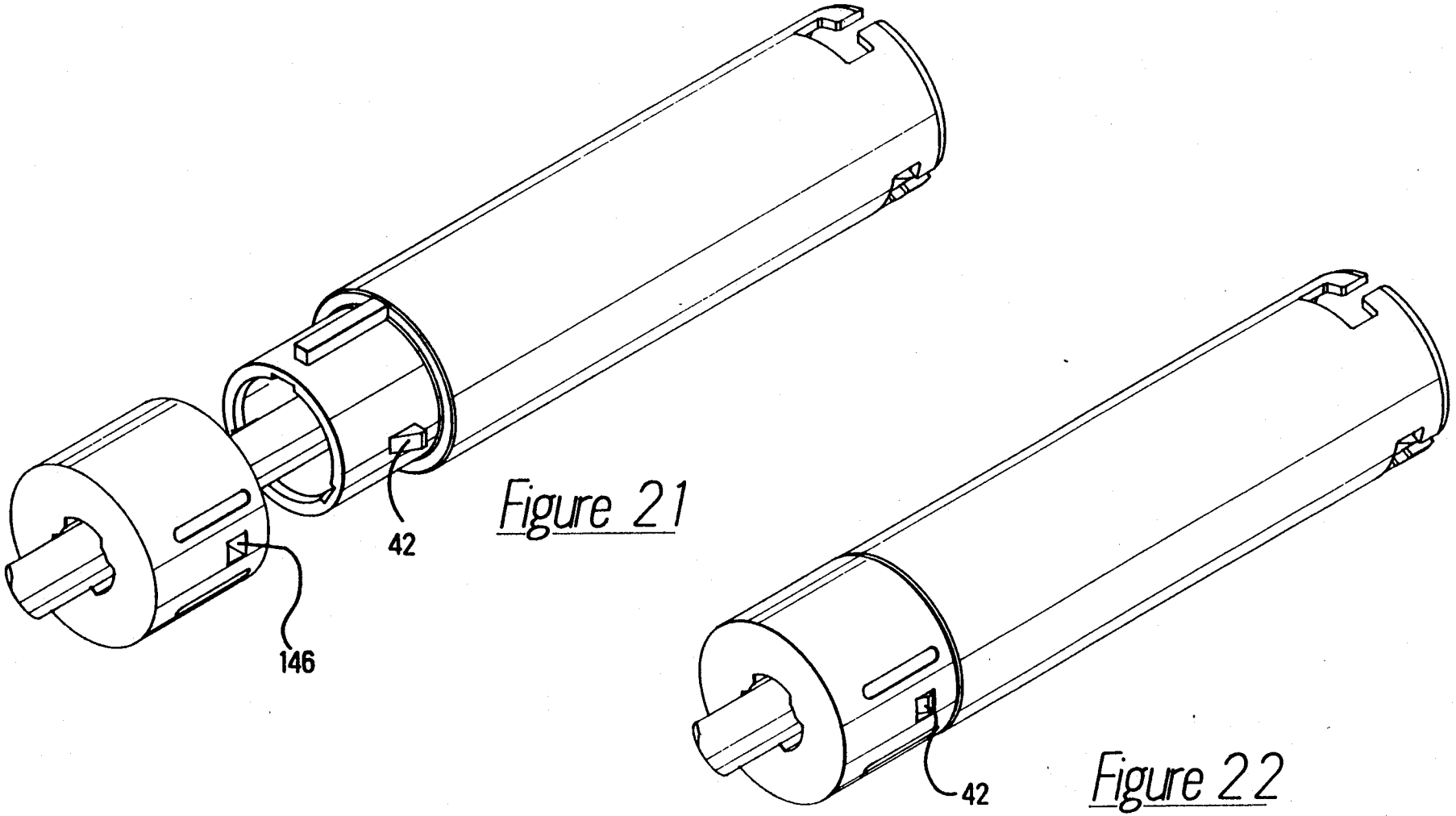
Figure 23:
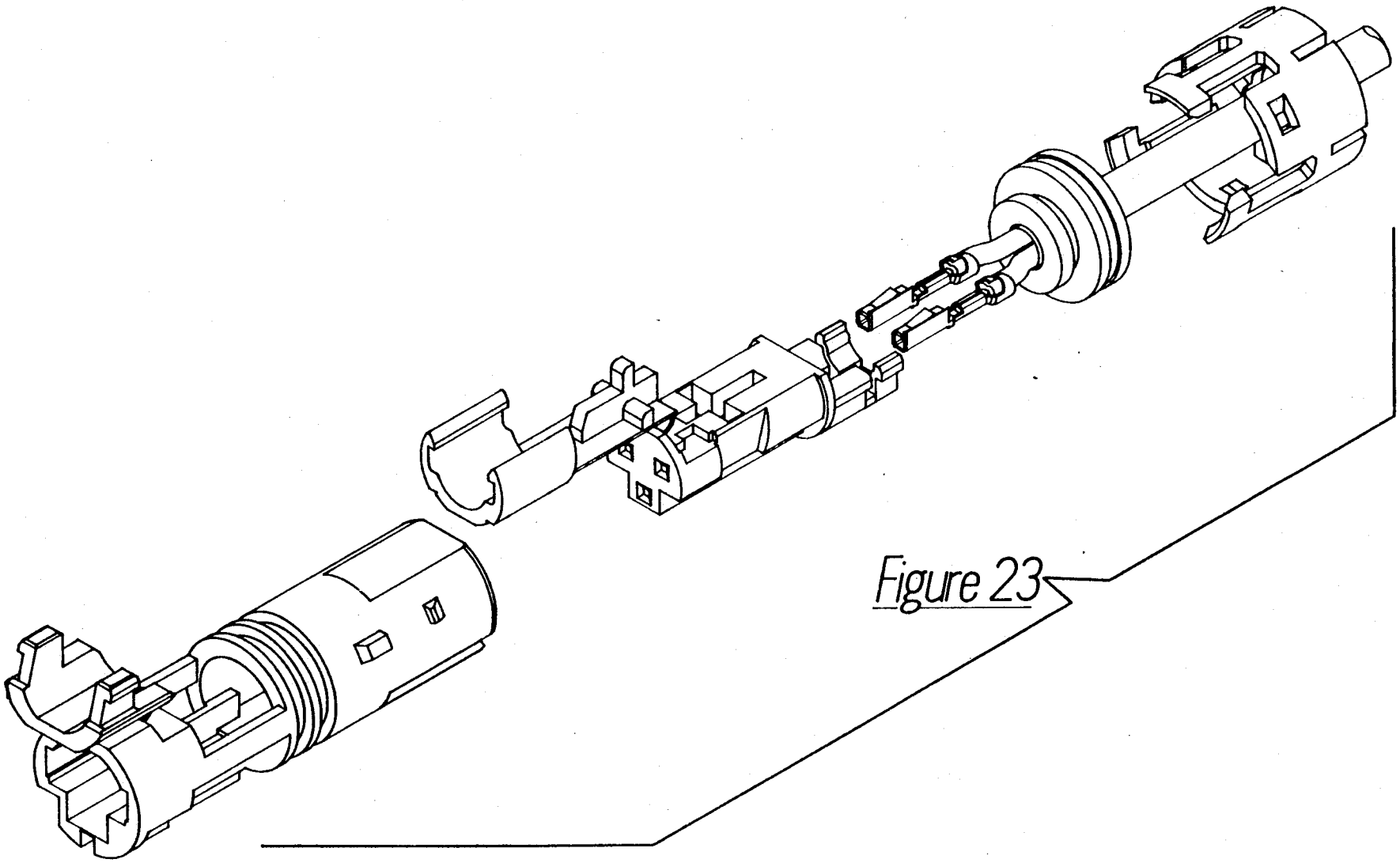
FIGS. 23–27 are isometric views showing the assembly of the socket assembly.
Figure 24:
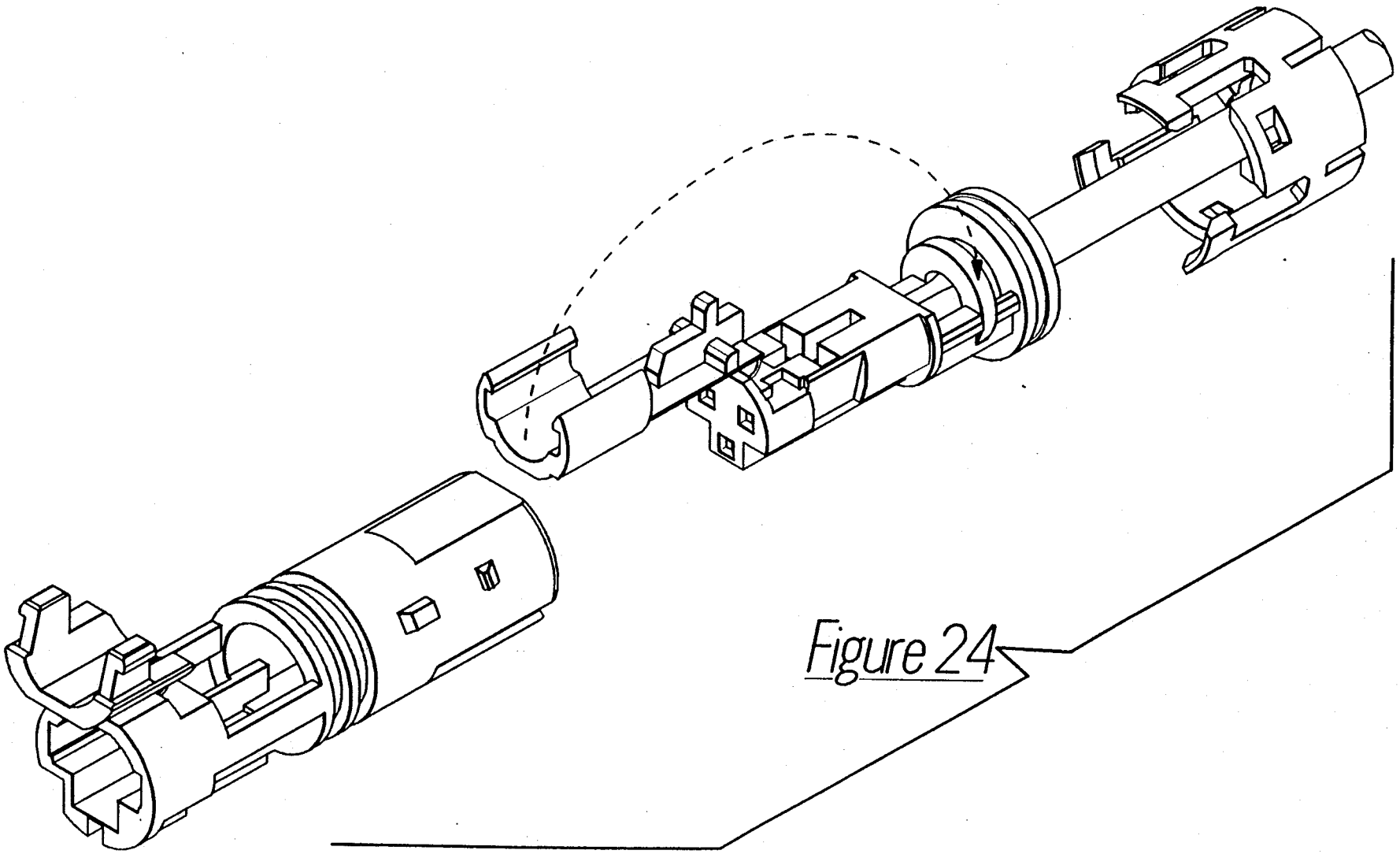
Figure 25:
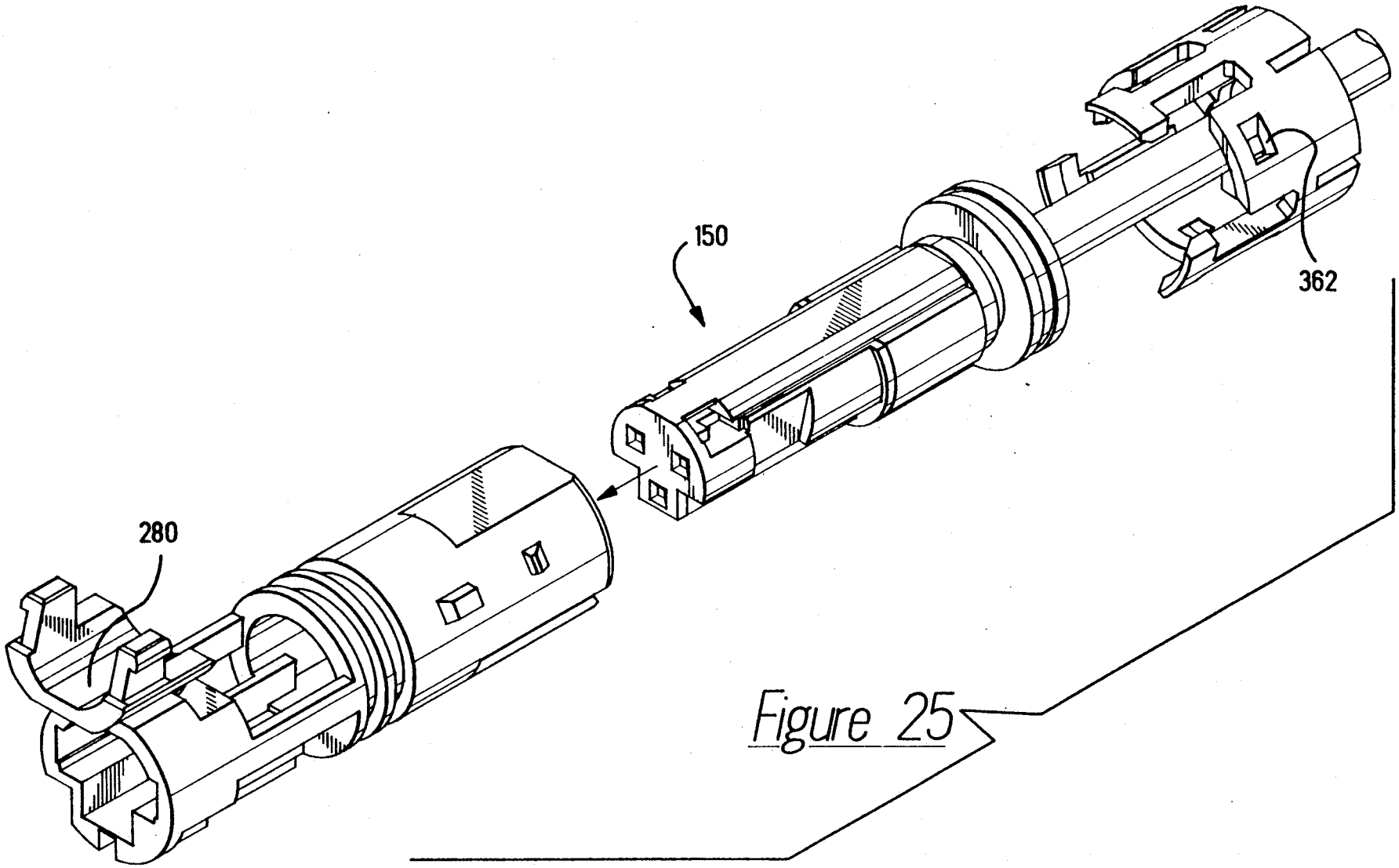

The receptacle assembly shown in FIG. 27 is now prepared for mating receipt to the pin housing as assembled in FIG. 22. The receptacle as assembled in FIG. 27 slideably received into the pin housing assembly as shown in FIG. 22 until the T bars 356 latch within the respective T slots 14. It should also be noted that the 0 rings 290 as shown in FIG. 15 have a larger outer diameter than the inner diameter 12 of the outer housing 4 which provides for a compressive seal between the interface of the two connectors.

Figure 28:
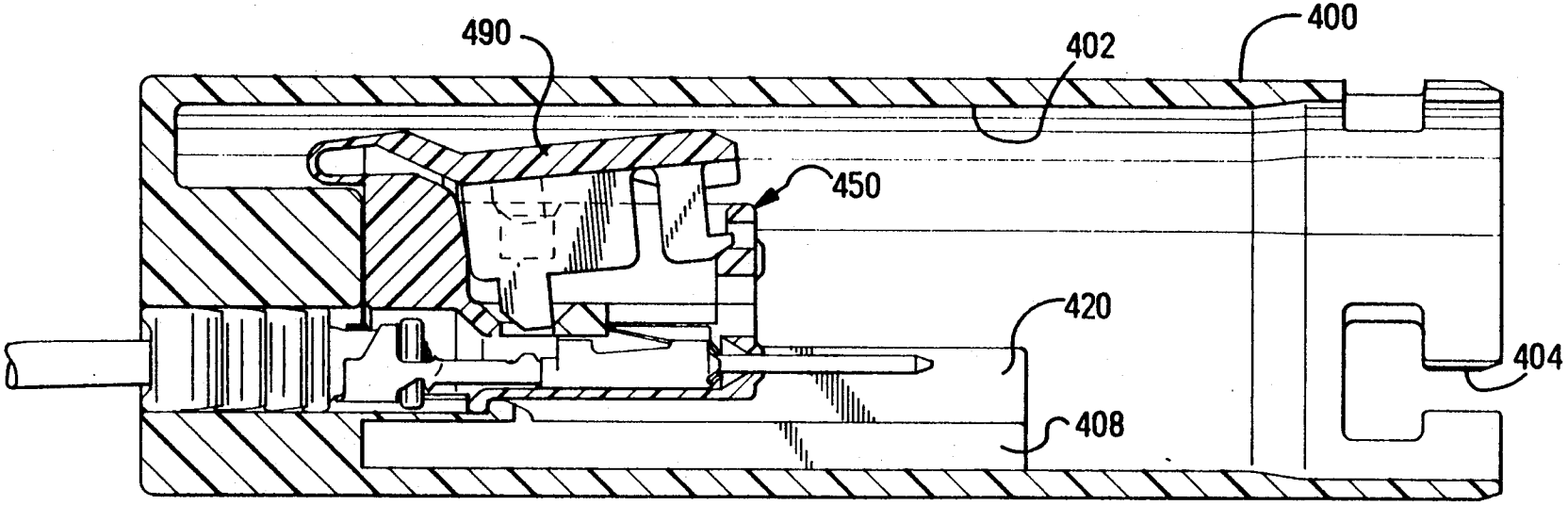
FIG. 28 is an alternate embodiment of the invention and more specifically is a cross-sectional view through lines 28–28 of the outer shell as shown in FIG. 36, including the assembly of the pin housing insert as shown in FIGS. 31 and 32.

As shown in FIG. 28, a second embodiment of the connector is shown as including a shell member 400 where a pin insert 450 is latchably retained therein. With reference now to FIGS. 35 through 37, the shell member will be described in greater detail.

As shown in FIG. 35 and 36, the shell 400 generally includes an inner bore surface 402 and a front mating end 403 including T-slots 404 similar to those in the first embodiment. The shell member also includes keying via alignment wedges 418 and 422 which extend forwardly from the rear of the shell member 400. In order to key the pin inserts with the various shells, a portion of keying wedge 420 extends from the portion 418 and has a narrower structure to allow for keying of the pin insert. It should be noted that with these keying wedges, several keyed arrangements are possible As shown in FIG. 36, a pillar portion 430 extends upwardly from the rear face 431 of the shell member 400 and includes a lower bore 432 and two upper bores 434 and 436. The pillar portion 430 extends upwardly from the rear face 431 of the shell member to an end surface 416 as shown in FIG. 35. From the end surface 416 of the pillar portion 430 three alignment members 406, 426 and 428 extend forwardly towards the front end of the shell member 400. Each of the alignment members 406, 426 and 428 have surfaces 414, 427 and 429 respectively, which are continuous with the inner surface of the bores 432, 436 and 434 respectively. The alignment member 406 is more complex than the other two alignment members 426 and 428, as the alignment member 406 also includes a latching feature comprising a ramped surface 410 as shown in FIG. 35 and a rearwardly facing shoulder 412. A bar 408 extends forwardly from the rear section of the alignment member and is positioned proximate to the front end 403 of the shell member for positioning of the pin insert during installation.

FIG. 37 shows an alternate embodiment of the shell 400' for a two position connector which would use two side by side bores similar to 434 and 436 (FIG. 36) where a third lower bore such as 432' is simply not molded into place.

With respect now to FIGS. 31–34, the pin insert will be described in greater detail The pin insert 450 generally comprises a body portion 452 and a flexible secondary lock portion 490. The housing portion 452 comprises a front mating face 454 and a rear face 456, with a plurality of terminal receiving passageways 458, 460 and 462 (FIG. 34) extending therebetween. With reference to FIG. 31, the terminal passageway 458 will be described in detail. The internal passageway 458 comprises a square aperture portion **458*b* which is in communication with a cylindrical bore portion 458*a* through a frusto-conical surface 458*d*. At the front face 454 of the housing portion, the aperture portion 458*c* is in communication with the inner terminal passageway 458*b*. As shown in FIG. 31 and 34, alignment members 468 and 470 extend from the rear face 456 of the housing portion 452. The alignment members 468 includes an upper semicylindrical portion 468*a*, a lower semi-cylindrical portion 468*b*, a lower vertical planar surface 468*c*, and an upper horizontal planar surface 468*d*. The alignment member 470 is a virtue mirror image of the alignment member 468 and therefore will not be described in detail. It should be noted here that the profiles of the semi-cylindrical surfaces 468*a*, 468*b*; 470*a*, 470*b* are profiled to overlap the pillar portion 430 (FIG. 36) of the shell member 400. It should also be noticed that the outer surfaces 470*e* and 470*f* are profiled to be received over the alignment wedge 422 whereas the outer surfaces 468*e* and 468*f* are profiled to be received over the alignment lugs 418 and 420**.

In a similar manner to the housing portions of the first embodiment, the pin housing 450 includes in the upper surface 474, a cross-shaped slot comprising an axial slot 476 and a transverse slot 480, as shown in FIG. 31. A vertical passageway 478 is continuous with the vertical slot 476 and also communicates with the lower passageway **458*b*. In a similar manner, the transverse slot 480 communicates with the upper passageways 460 and 462. As shown in FIGS. 31 and 33, the front face 454 of the housing portion 452 further includes two apertures 490 and 491** which provide for latching purposes and will be described in greater detail herein.

The pin housing member 450 also includes a hinged rotatable secondary lock portion 490 which is integrally molded to the housing portion 452 via a web 492 of plastic material. The secondary lock portion 490 comprises a plate member 494 having an axial bar 500 extending upwardly with a vertical peg portion 502 and a transverse bar portion 504, all integral with the plate portion 494. A vertical upstanding latching leg 506 is also included having a latching peg 508. As shown in FIGS. 31 and 34 two alignment pegs 510 and 512 also upstand from the upper surface of the plate portion 494.

With reference now to FIGS. 38–42, the socket housing of the second embodiment will be described in greater detail. The socket housing 520 generally includes a mating end 522 and a cable receiving end 524. The socket housing 520 includes a plurality of socket receiving passageways 526, 528 and 530 which extend from a rear face 525 forwardly to an inner surface 534. Each of the terminal receiving passageways such as 526 generally includes a pin receiving aperture **526*b*, a square shaped aperture 526*a* and a sealing bore surface 526*c*. With reference to FIG. 42, the mating end 522 includes an aperture 532 defined by the semi-circular inner surface 532*a*, the horizontal surfaces 532*b*, 532*c* and 532*f*; and vertical surfaces 532*d* and 532*e*. Each of these surfaces extends from the front end 522 to a rear face 534. It should be noted that these inner surfaces 532*a*–532*f*, are cooperatively profiled to receive the mating end of the pin socket 450 as shown in FIG. 33**.

As shown in FIG. 38, a T-shaped slot 536 is in laterally centered relative to the lower terminal receiving passageway 526 and generally includes an axial slot 538 and a transverse slot 542. As best shown in FIG. 39, a vertical slot 544 extends downwardly from the axial slot 538 and communicates with the forward bore 526 of the terminal passageway. The transverse slot 542 communicates with the passageways 528 and 530. A hinged secondary lock 590 is integrally molded to the socket housing via a integral web 592. The secondary lock 590 includes a circular plate portion 594 which is profiled to overlay the semi-circular opening 539 at the top of the socket housing. The secondary lock 590 also includes an axial bar 600 from which extends a vertical peg section 602. A transverse bar 604 also extends from the circular plate portion 594.

When in the locked position, the axial plate portion 600 is positioned in the axial slot 538, the transverse bar 604 is positioned in the transverse slot 542 with a section of the vertical peg extending into the terminal receiving cavities and the vertical peg 602 is positioned in the vertical slot 544 with a portion of the vertical peg extending into the terminal passageway 526 It should be noted in FIG. 40, that the terminal receiving passageway 528 is shown in phantom with the transverse bar section 604 extending into the terminal passageway 528.

As shown in FIG. 41, three latch arms 531 extend from the rear of the socket housing 520 and as shown in FIG. 38 include ramped surfaces 531*a* and a latching arm 31*b*.

With reference now to FIG. 43 and 44, the terminal used in the pin housing is shown as a completed cable assembly 620 comprising a pin terminal 622, a grommet seal section 624 and a cable 626. The pin terminal generally comprises a forward pin section 622*a*, a lance section 622*b* which is stamped from and extends above a generally box shaped section 622*f*. A vertical plate portion 622*e* upstands above the top surface of the box shaped section 622*f* as shown in FIG. 43. The pin terminal 622 also comprises a crimp section 622*c* which terminates the individual conductor 626*a* of the electrical cable 626 thereto. The pin terminal 622 also includes a strain relief section 622*d* which is crimped around a reduced diameter section 624*c* of the grommet 624 and behind a forward portion 624*d* of the grommet 624.

With reference now to FIGS. 45 and 46, the socket cable assemblies 640 are shown as generally including a socket terminal 642, a wire sealing grommet 624 and an electrical conductor 626. It should be noted that the grommets and the socket assembly 640 are identical to the grommets in the pin terminal assemblies 620. The socket terminals 642 generally comprise opposed contacts 642*a*, a retention lance 642*b*, and a crimp section 642*c* which is electrically connected to the conductor 626*a* of the cable 626. The strain relief section 642*d* of the terminal 642 is wrapped around the reduced diameter section 624*c* of the grommet 624 directly behind the forward rib 624*d* of the grommet 624. As in the pin terminal 622, the socket terminal 642 also comprises a vertical plate section 642*e* which upstands vertically higher than the box shaped section 642*f*.

To assemble the second embodiment of the invention, the pin housing 450 is assembled by starting with the housing 450 as shown in FIG. 31 with the secondary lock member 490 in an unlatched position. The lock member 490 is now rotated such that the vertical plate 500 is inserted into the axial slot 476 and the latch arm 506 is brought into registry with the first aperture 490 such that the locking peg 508 on the latch are 506 is situated in the first or upper aperture 490. It should be noted that FIG. 28 shows the pin housing 450 in this position and, when in this position, the vertical peg 502 and the transverse bar section 504 do not extend into the terminal receiving passageways, but rather are slightly above the passageway.

The pin housing 450 may now be placed in the front of the shell member 400 such that the space between the walls 470*d* and 472*a* (FIG. 34) are aligned with the alignment member 428, and that the space between the two surfaces 472*b* and 468*d* are aligned with the horizontal alignment member 426. This will also align the alignment member 406 with the space between the two surfaces 468*c* and 470*c*. It should be noted that when in place, the surfaces 427, 429 and 414 (FIG. 36) actually complete the pin terminal passageways 460, 462 and 458, (FIG. 34) respectively. Said differently, the terminal receiving passageways, for example, terminal passageway 458, is partially cylindrical from the position 458*h* to the rear wall 456 (FIG. 31). The surfaces 468*c* and 470*c* (FIG. 34) form an open seam along the entire length of the cylindrical passageway 458*a*. When the pin housing 450 is inserted into the shell member 400, the surface 414 (FIG. 35) is received between the two surfaces 468*c* and 470 thereby completing the terminal passageway 458. Conveniently, the alignment member 406 (FIG. 35) also includes the latching shoulder 412 which will latch behind the surface 466 (FIG. 31) to lock the pin housing in place as shown in FIG. 28.

Since the latching shoulder 412 is an extension of the bore 432, the outer periphery of the shell member 400 is uninhibited with further apertures defined by with drawing mold dies to provide latching surfaces Said differently, when a latching surface has to be formed on an interior of a housing, and when the latching surface is rearwardly facing, a mold die must be pulled from the rear to form that rearwardly facing latch surface. However, in this case, the bore has to be formed anyway, so that the latching structure which retains the shell and the pin housing together is simply an extension of the bore which is already to be molded. This is quite advantageous when the connector assembly is to be sealed, because no other apertures need to be filled or sealed in any other manner.

With the secondary lock member 490, in the position shown in FIG. 28, the pin terminal assemblies 620 can be inserted into the three rear apertures 432, 434 and 436. Continued insertion of the pin section 622*a* through the pin through hole 458*c* will position the retention lance 622*b* (FIG. 43) against the latching shoulder 458*f* (FIG. 31) to form the primary retention feature for the pin terminals. With all three pin terminals in place as described above, a narrow tool such as a thin bladed tool can be inserted into the bore 402 of the shell member to move the secondary lock into its locked position, that position being shown in FIG. 32 where the locking peg 508 now resides in the second or lower aperture for 491. It should be noted that when the secondary lock member is in the position shown in FIG. 28, the connector halves could not be mated. When in the locked position as shown in FIG. 32, the transverse bar 504 will reside in the transverse slot 480 and the vertical peg 502 will extend into the vertical aperture 478 such that both the transverse bar 504 and the vertical peg 502 extends into the envelope of the terminal passageways and will be locked behind the sheared surface 622*g* (FIG. 44) of the pin terminals 622.

In a similar manner, the socket terminals 642 are inserted into their respective passageways 526, 528 and 530 in the socket housing 520 to a position where the end retention lances 642*b* is located within the aperture 540 (FIG. 39). The secondary retention member 590 can now be brought into latched position where the axial bar 600 will reside in the axial slot 638 such that the vertical peg 602 and the transverse bar extend into the respective passageways 544 and 542 respectively when in this position the vertical peg 602 will reside in the terminal receiving passageway 526*a* and the transverse bar 604 will extend into the terminal receiving passageways 528 and 530 and in abutting relation with the sheared edge 642*g* (FIG. 46) of the socket terminal 642.

As assembled, the socket housing assembly is insertable into the shell so that the pins and socket members are matable. In the fully latched position, the latching members 531*b* (FIG. 38) will reside in the T slots 404 (FIG. 35) of the shell member. It should be noted that when in this position, the internal electrical components are entirely sealed from exterior moisture or contaminants. This seal is provided by the discrete seals 624 residing in compression in the respective bores 432, 434 and 436 of the shell housing and in bores 526, 528 and 530 in the socket housing. It is also sealed by the fact that an O ring 612 is included in an O-ring groove 610 (FIG. 39) such that when the socket housing is inserted into the shell member the O-ring is in compression against the inner surface 402 of the shell housing.

We claim:

1. An electrical connector, comprising:

an insulative housing having a front mating face and a rear face, said housing having a plurality of terminal receiving passageways extending between said front and rear faces, said terminal passageways being disposed in at least two rows, where an upper row has at least two passageways, and a lower row has at least one passageway, said lower row being laterally staggered from said upper row, said housing further including passage means communicating with said upper and lower rows, said passage means comprising a transverse slot laterally spanning and interecting said upper row of terminal passageways, said passage means further comprising a vertical aperture extending from said transverse slot and intersecting said at least one lower passageway;

a plurality of electrical terminals having contact portions positioned adjacent to said front mating face, said terminals further comprising a retaining shoulder positioned adjacent to and forward of said passage means; and a retaining member comprising a transverse bar and a locking peg, said transverse bar being receivable in said transverse slot and said locking peg being receivable in said vertical aperture, said bar and peg being positioned behind said retaining shoulder of respective electrical terminals to retain said electrical terminals in corresponding passageways.

2. The electrical connector of claim 1, wherein said retaining member is integrally connected to said housing.

3. The electrical connector of claim 2, wherein said retaining member is defined in the form of a hinged flap interconnected to said housing by way of a web of material.

4. The electrical connector of claim 2, wherein said retaining member further comprises an axial bar section extending perpendicular to said transverse bar, and said vertical peg extends integrally from said axial bar section, said passage means further comprising an axial sot profiled to receive said axial bar.

5. The electrical connector of claim 4, wherein said passage means is cruciform in shape.

6. The electrical connector of claim 4, wherein said passage means is T-shaped.

7. The electrical connector of claim 1, wherein said housing is generally circular in cross-section, save for a top planar surface through which said transverse slot extends, said hinged flap having a segmental cross-section complementary with said top planar surface to form a completed generally circular cross-section.

8. The electrical connector of claim 7, wherein said housing is insertable into a cylindrical outer housing portion.

9. The electrical connector of claim 1, wherein said housing comprises a rear cable receiving section extending from said rear face, said cable receiving section comprising a longitudinal wire receiving nest and a transverse groove intersecting said nest, said retaining member further comprising gripping arms extending therefrom, said gripping arms being latchably attached to said cable receiving section, and a seal profiled to surround an electrical cable, said seal having a forward rib for insertion in said transverse groove, whereby when said seal is positioned in said nest with said forward rib positioned in said transverse groove, and said gripping arms are latched to said cable receiving section, said seal is longitudinally retained to said housing.

10. The electrical connector of claim 9, wherein said housing si insertable into an outer housing, and said seal comprises sealing ribs extending rearwardly therefrom profiled for sealing engagement against an inner diameter of said outer housing.

11. A sealed electrical connector for interconnection to a multiconductor cable, comprising:

an inner insulative housing portion comprising a front mating face and a rear face, and a cable receiving section extending from said rear face comprising a seal receiving nest, said housing including terminal receiving passageways extending between said front and rear faces;

electrical terminals positioned in said passageways, said terminals comprising electrical contact portions positioned adjacent to said front mating face;

means to retain said electrical terminals in said passageways;

a seal member receivable over the cable and adapted for receipt within said seal receiving nest;

a seal locking member receivable over said seal and latchably attachable to said housing to retain said seal to said housing; and an outer housing profiled for receiving said inner housing, said outer housing having an inner diameter profiled for sealing tight engagement with an outer diameter of said seal member.

12. The electrical connector of claim 11, wherein said inner housing comprises a passage means therethrough in communication with said terminal receiving passageways, and said terminal retaining means are receivable through said passage means to retain said terminals.

13. The electrical connector of claim 12, wherein said inner housing comprises at least two rows of electrical terminals, an upper row having at least two passageways and a lower row having at least one passageway, said at least one passageway in said lower row being positioned laterally intermediate said at least two passageways in said upper row, said passage means comprising a transverse slot spanning, and intersecting with, said at least two passageways in said upper row, said passage means further comprising a vertical aperture extending downwardly from said transverse slot and intersecting said at least one passageway in said lower row.

14. The electrical connector of claim 11, wherein said cable receiving nest includes a transverse groove therethrough, whereas said seal member includes a forward rib receivable in said groove and said seal locking member include arms for encompassing said rib to longitudinally retain said seal member to said inner housing.

15. The electrical connector of claim 14, wherein said terminal retaining means and said seal locking member are integral with a flap member, hingedly connected to said inner housing by way of a web of material.

16. A sealed electrical connector for interconnection to a multiconductor cable, comprising:

an insulative housing portion comprising a front mating face and a rear face, and a cable receiving section extending from said rear face comprising a seal receiving nest having a transverse groove therein, said housing including terminal receiving passageways extending between said front and rear faces;

electrical terminals positioned in said passageways, said terminals comprising electrical contact portions positioned adjacent to said front mating face;

means to retain said electrical terminals in said passageways;

a seal member receivable over the cable and adapted for receipt within said seal receiving nest, said seal member having a forward rib receivable in said transverse groove; and a seal locking member receivable over said seal and latchably attachable to said housing to longitudinally retain said seal to said housing.

17. The electrical connector of claim 16, wherein said seal member comprises outer sealing ribs adjacent an end thereof, and said electrical connector further comprises an outer housing, where said housing is insertable into said outer housing, said outer housing having an inner diameter adapted for sealing tight engagement with said outer sealing ribs.

18. The electrical connector of claim 16, wherein said terminal retaining means and said seal locking member are integral with a flap member, hingedly connected to said inner housing by way of a web of material.

19. The electrical connector of claim 16, wherein said inner housing comprises a passage means therethrough in communication with said terminal receiving passageways, and said terminal retaining means are receivable through said passage means to retain said terminals.

20. The electrical connector of claim 19, wherein said inner housing comprises at least two rows of electrical terminals, an upper row having at least two passageways an da lower row having at least one passageway, said at least one passageway in said lower row being positioned laterally intermediate said at least two passageways in said upper row, said passage means comprising a transverse slot spanning, and intersecting with, said at least two passageways in said upper row, said passage means further comprising a vertical aperture extending downwardly, intersecting said at least one passageway in said lower row.

* * * * *